US007461529B2

(12) United States Patent
Clark

(10) Patent No.: US 7,461,529 B2
(45) **Date of Patent: *Dec. 9, 2008**

(54) METHODS AND APPARATUS FOR MONITORING AND CONDITIONING STRIP MATERIAL

(75) Inventor: John Dennis Clark, McPherson, KS (US)

(73) Assignee: The Bradbury Company, Moundridge, KS (US)

( * ) Notice: Subject to any disclaimer, the term of this patent is extended or adjusted under 35 U.S.C. 154(b) by 122 days.

This patent is subject to a terminal disclaimer.

(21) Appl. No.: 11/359,025

(22) Filed: Feb. 22, 2006

(65) Prior Publication Data

US 2006/0137418 A1 Jun. 29, 2006

Related U.S. Application Data

(63) Continuation-in-part of application No. 10/662,567, filed on Sep. 15, 2003, now Pat. No. 7,185,519.

(51) Int. Cl.
*B21B 37/00* (2006.01)

(52) U.S. Cl. ..... 72/7.4; 72/9.1; 72/11.7; 72/164

(58) Field of Classification Search ..... 72/7.4, 72/8.3, 9.1, 9.2, 11.7, 164
See application file for complete search history.

(56) References Cited

U.S. PATENT DOCUMENTS 3,199,391 A * 8/1965 Lambert et al. ..... 83/359
3,416,340 A * 12/1968 Reesor ..... 72/11.7
RE26,996 E * 12/1970 Beadle ..... 72/11.8
3,724,251 A 4/1973 Wegner
4,033,165 A 7/1977 Arimura et al.
4,145,905 A 3/1979 Mattie
4,439,049 A * 3/1984 Hoogendoorn et al. ..... 374/124

(Continued)

FOREIGN PATENT DOCUMENTS

CA 2167014 8/2001

(Continued)

OTHER PUBLICATIONS

The Bradbury Company, Inc. "Introduces the Auto-corrective Leveler." 1985. pp. All.

(Continued)

*Primary Examiner*—Dana Ross
*Assistant Examiner*—Debra M Wolfe
(74) *Attorney, Agent, or Firm*—Hanley, Flight & Zimmerman, LLC

(57) ABSTRACT

Methods and an apparatus for monitoring and conditioning strip material are disclosed. The disclosed methods and apparatus receive encoder signals and sensor data to monitor a condition of a strip material. The system obtains a plurality of sensor readings associated with the condition of the strip material, converts the readings into a dimensional profile, and outputs a visual display of the dimensional profile. If an undesired material condition is detected, a material conditioner is adjusted to achieve a desired material condition. Each time the strip material passes a sensor, data associated with the strip material is recorded. The dimensional profile is additionally shown to an operator to facilitate the input of commands by the operator used to urge the material toward a desired profile.

15 Claims, 25 Drawing Sheets

U.S. PATENT DOCUMENTS

| | | | | |
|---|---|---|---|---|
| 4,454,738 | A | 6/1984 | Buta | |
| 4,635,458 | A | 1/1987 | Bradlee | |
| 4,674,310 | A * | 6/1987 | Ginzburg | 72/11.4 |
| 4,794,773 | A | 1/1989 | Bradlee | |
| 4,872,330 | A | 10/1989 | Nonini | |
| 4,910,985 | A * | 3/1990 | Ballyns | 72/10.4 |
| 4,928,257 | A * | 5/1990 | Yerkes et al. | 702/40 |
| 5,060,498 | A | 10/1991 | Seto et al. | |
| 5,193,066 | A * | 3/1993 | Konishi et al. | 700/154 |
| 5,465,214 | A | 11/1995 | Jeuniaux et al. | |
| 5,953,946 | A | 9/1999 | Mücke et al. | |
| 6,345,524 | B1 | 2/2002 | Fischer | |
| 6,434,994 | B2 | 8/2002 | Bradbury et al. | |
| 6,766,278 | B2 * | 7/2004 | Liu et al. | 702/188 |
| 6,769,279 | B1 | 8/2004 | Bergman et al. | |
| 6,948,347 | B2 * | 9/2005 | Russo et al. | 72/9.1 |
| 2005/0056067 | A1 | 3/2005 | Clark | |

FOREIGN PATENT DOCUMENTS

| | | |
|---|---|---|
| DE | 10132105 A1 | 8/2002 |
| EP | 0865839 | 9/1998 |
| JP | 63013616 | 1/1988 |

OTHER PUBLICATIONS

The Bradbury Company, Inc. "Leveling." 1989. pp. All.
The Bradbury Company, Inc. "Corrective Roller Levelers for Superior Flatness." 1996. pp. All.
Bradbury, Philip E. "Corrective Roller Leveling." 1997. pp. All.
The Bradbury Company, Inc. "The Pressroom Leveler." Published at Fabtech International 1999, Chicago, IL. Nov. 14-18, 1999. pp. All.
Pennington, J.N., CNC Slitter Replaces Packaging with Programming. Modern Metals, Sep. 2004, pp. 49-51.
Eiting, J; Bergman, G; Enneking, T. "Machine Concepts Letter" Feb. 11, 2003. pp. All.
The Bradbury Company, Inc. "Precision Straightener With Quick Change Roll Cassette System." Retrieved from Internet: <URL: http://www.machineconcepts.com/PrecisionStraightener.asp>. Retrieved on Mar. 11, 2003; copy printed on Jul. 25, 2006.
ASTM International "Standard Specification for Steel, Sheet, Carbon, and High-Strength, Low-Alloy, Hot-Rolled and Cold-Rolled, General Requirements for" May 2003. pp. All.
European Patent Office, "European Search Report" Nov. 23, 2004. 3 pages.
European Patent Office, "European Examination Report" Feb. 1, 2006. 4 pages.
Extended European Search Report corresponding to European Patent Application No. 07022620.4, 6 pages, Jan. 24, 2008.
Communication from the European Patent Office under Rule 51(4) EPC corresponding to European Patent Application No. 04020054.5, 5 pages, Sep. 11, 2007.
The Bradbury Group, "Flat Trak," Date unknown, copyright 2003, 2 pages.

* cited by examiner

Reducing center distance increases tension area.

Increasing plunge increases tension area.

METHODS AND APPARATUS FOR MONITORING AND CONDITIONING STRIP MATERIAL

CROSS REFERENCE TO RELATED APPLICATIONS

The present disclosure is a continuation-in-part of U.S. patent application Ser. No. 10/662,567, now U.S. Pat. No. 7,185,519, entitled "Methods and Apparatus for Monitoring and Conditioning Strip Material," filed on Sep. 15, 2003, and incorporated herein by reference in its entirety.

TECHNICAL FIELD

The present disclosure pertains to strip material processing and, more particularly, to methods and apparatus for monitoring and conditioning strip material.

BACKGROUND

Many products such as construction panels, beams and garage doors are made from strip material that is pulled from a roll or coil of the strip material and processed using rollforming equipment or machines. A detailed description of a rollforming machine may be found in U.S. Pat. No. 6,434,994, which is incorporated herein by reference in its entirety. A rollforming machine typically removes strip material (e.g., a metal) from a coiled quantity of the strip material and progressively bends and forms the strip material to produce a product profile and, ultimately, a finished product.

Uncoiled rolled metal or strip material may have certain undesirable characteristics such as, for example, coil set, crossbow, buckling along one or both outer edges, mid-edges or a center portion, etc. As a result, the strip material removed from a coil typically requires conditioning (e.g., flattening and/or leveling) prior to subsequent processing in a rollforming machine. Typically, the strip material is conditioned by flattener or a leveler to have a substantially flat condition. However, in some applications it may be desirable to condition the strip material to have a non-flat condition. For example, the strip material may be conditioned to have a particular bowed condition to facilitate a subsequent rollforming process in which the conditioned strip material may be cut, bent, punched, etc. to produce a finished product.

Strip material removed from coils is often conditioned (e.g., flattened) using a leveler, which is a well known type of apparatus. A leveler typically includes a plurality of work rolls. Some of the work rolls are adjustable to enable the stresses applied by the work rolls to the strip material being processed to be varied across the width of the strip material. In this manner, one or more selected longitudinal regions or zones (e.g., outer edges, mid-edges, a center portion, etc.) of the strip material can be permanently stretched to achieve a desired finished material condition (e.g., flatness).

To achieve a desired material condition, the settings of the adjustable work rolls are usually initially selected based on the type and thickness of the material to be conditioned. For example, a control unit coupled to the leveler may enable an operator to enter the material type and thickness. Based on the material type and thickness information entered by the operator, the control unit may retrieve appropriate default work roll settings. The operator may then vary the default work roll settings prior to conditioning the material and/or during the conditioning process to achieve a desired finished material condition. For example, an operator at an inspection point near the output of the leveler may visually detect an undesirable material condition such as a crossbow condition, a coil set condition, a buckle or wave along one or both of the outer edges, mid-edges, the center, or any other longitudinal region or zone of the strip material being processed, etc. Unfortunately, manually configuring or adjusting a leveler in this manner to condition strip material to achieve a desired condition can be a time consuming and error prone process, particularly due to the high degree of human expertise and involvement required.

Using a leveler to process strip material may additionally or alternatively involve a certification process. For example, quantities of cut sheets of the strip material processed by a leveler may be bundled for shipment. A plurality of sheets may be sampled from each bundle and the sampled sheets may be visually inspected and manually measured by an operator. The visual inspection and quantitative measurements may be used to generate, for example, flatness information for the sampled sheets. In turn, the flatness information for the sampled sheets selected from each bundle may be used as statistical information for purposes of certifying the bundles from which the sheets were selected. However, as is the case with known leveler adjustment apparatus and methods, known certification processes are very time consuming and prone to error due to the high degree of human expertise and involvement required.

DETAILED DESCRIPTION

In general, the example system described herein receives encoder signals and distance sensor data in order to automatically monitor and/or condition strip material. If an undesirable material condition (e.g., crossbow, coil set, buckles or waves in one or more regions or zones of the strip material, etc.) is detected, one or more work rolls in a material conditioner (e.g., a leveler) may be adjusted to achieve a desired material condition (e.g., flatness). Alternatively or additionally, the example system described herein may automatically produce certification information for predetermined quantities (e.g., individual bundles of sheets) of the strip material.

Figure 1:
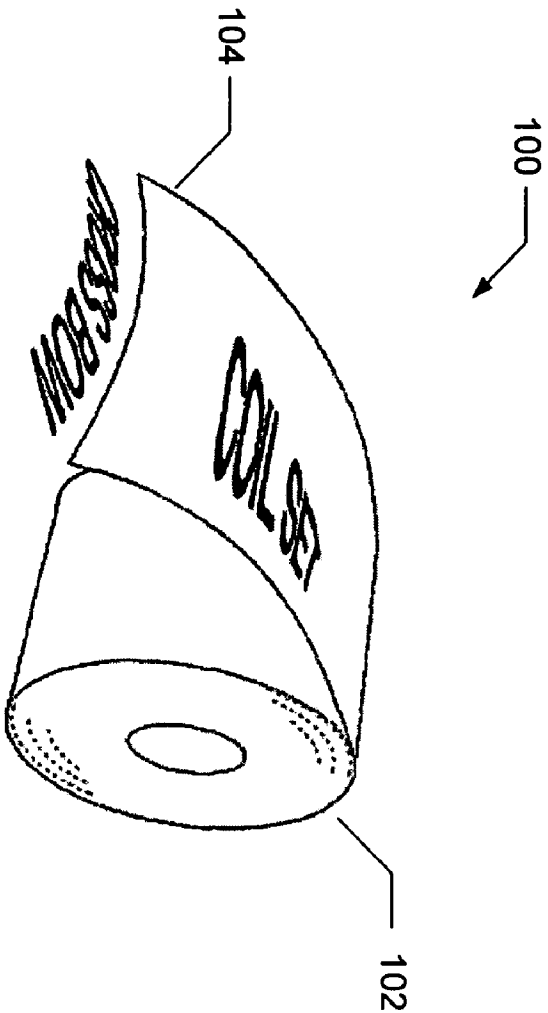
FIG. 1 illustrates an example of a strip material being pulled from a coiled quantity of the strip material.

FIG. 1 illustrates an example of a strip material 100 being pulled from a coiled quantity 102 of the strip material. The strip material may be a metallic substance such as, for example, steel or aluminum, or may be any other desired material. As the strip material 100 is removed from the coiled quantity 102, it assumes an uncoiled condition or state 104. Coiled strip material frequently manifests undesirable material conditions that are the result of longitudinal stretching of the strip material during coiling and as a result of remaining in a coiled condition for a period of time. In particular, the coil winding process is usually performed under high tension, which may cause a condition commonly referred to as coil set. If significant, coil set may also manifest itself as a condition commonly referred to as crossbow.

Both of these undesirable conditions are manifest in the uncoiled condition or state 104.

In addition, during a cold mill reduction process, rolling mill conditions and settings may manifest themselves as imperfections in the finished coil. These imperfections appear as waves when they occur near the peripheral zones or regions (e.g., the outer edges) of the strip material 100 and as buckles when they occur near the central zone or region (e.g., the center) of the strip material 100. In a case where the uncoiled condition or state 104 exhibits coil set, the stretching that has occurred is typically uniform across the width of the strip material 100. For example, with over-wound coils, the outer surface is uniformly stretched slightly more than the inner surface. Thus, the uncoiled portion 104 of the strip material 100 usually curves toward the inside wrap. As the uncoiled portion 104 is pulled straight, the longer upper surface will cause the shorter inner surface to curl slightly inward (i.e., crossbow).

Undesirable material conditions such as coil set and crossbow can be substantially eliminated using leveling or flattening techniques. Leveling or flattening techniques are based on the predictable manner in which the strip material 100 reacts to stress (i.e., the amount of load or force applied to a material). The structure and characteristics of a strip material change as the load and, thus, stress is increased. For example, with most metals, as the load or force increases from zero the metal supporting the load bends or stretches in an elastic manner. When the load or force applied remains within the elastic load region of the metal and is removed, the metal returns to its original shape. In such an instance, the metal has been flexed, but has not been bent.

At some point, an increase in the load or stress applied to the strip material causes the strip material properties to change so that it is no longer able to return to its original shape. When it is in this condition, the strip material is in a plastic load region. In the plastic load region, small increases in the force or load applied to the strip material cause relatively large amounts of stretching (i.e., deformation) to occur.

Further, when a metallic strip material is in plastic state or condition, the amount of stretch that results is time dependent. In particular, the longer the metal is held under a given load (when plastic) the greater the amount of deformation (i.e., permanent stretch).

The amount off force required to cause a metal to change from an elastic condition to a plastic condition is commonly known as yield strength. With a specific formulation of a particular metal, the yield strength is always the same. The higher the yield strength, the stronger the metal. Because leveling or flattening requires a portion of the metal to become plastic, yield strength is as important as thickness when determining appropriate work roll geometries and settings.

Factors such as the percent of elongation cause various metals to react differently to increased load. For example, aluminum will generally stretch much more (i.e., is more elastic) than steel, even if the aluminum and steel have the same yield strength. As a result, most aluminum, in comparison to steel, requires deeper work roll plunge (discussed in detail below) to achieve the same result. In other words, aluminum has to be stretched to a greater degree even though it has the same yield strength as steel. These differences in elasticity can be so significant that many metals such as aluminum appear to require more work than higher strength steels because of the deeper work roll plunge required to achieve a desired material condition.

Figure 2:
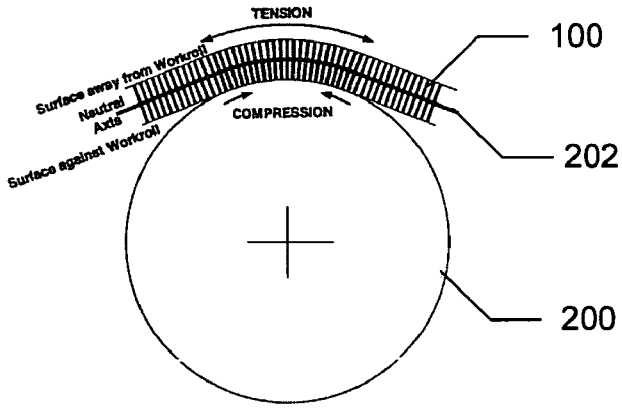
FIG. 2 illustrates example areas of compression and tension on a section of strip material passing over a work roll.

Conditioning a strip material depends strongly on the reaction the strip material 100 has to being bent around a work roll. FIG. 2 illustrates example areas of compression and tension on a section of the strip material 100 passing over a work roll 200. When wrapped around the work roll 200, compressive stresses occur in the portion of the strip material 100 closest to the work roll 200 and tensile stresses occur in the portion of the strip material 100 farthest away from the surface of the work roll 200. When the strip material 100 is pulled flat, the center is the neutral axis 202, which is neither in compression nor tension.

Although a strip material such as a metal is typically a homogenous substance, the conditioning concepts described herein may be easier to understand if the stresses are described as occurring in layers. As shown in FIG. 2, the greatest tension is in the outermost layers of the strip material 100. Unless sufficient tension is imparted to the strip material 100, the stresses will result in only elastic strain, and the strip material 100 will return to its original shape after passing over the work roll 200.

However, if sufficient tension is imparted to the strip material 100, the outer surface layers are subject to sufficient stress to reach the yield strength of the strip material 100. The surface layers stretch enough to become plastic and, when the tension is removed, retain a new shape. The plastic deformation is greatest at the surface of the strip material 100 farthest from the work roll 200. The tension imparted to the strip material varies across its thickness and, in particular, diminishes toward the neutral axis 202. For the layers of the strip material 100 that are near to or on the neutral axis 202, the tension is low enough that those layers of the strip material 100 are in an elastic state and, thus, are not deformed as a result of passing over the work roll 200.

The relationship between the diameter of the work roll 200 and thickness of the strip material 100 is a significant factor in the ability of a conditioner (e.g., a leveler) to condition the strip material 100 in a desired manner. For example, if the diameter of the work roll 200 is too large, the resulting stresses produce only elastic strains. In such an instance, after the strip material 100 passes over the work roll 200, the strip material 100 returns to its original shape.

Figure 3:
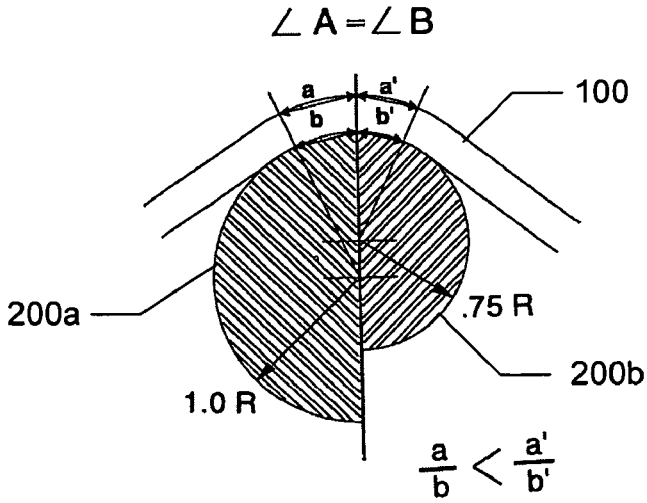
FIG. 3 generally illustrates the relationship between work roll diameter and the relative sizes of the compression and tension areas imparted by a work roll on a strip material.

FIG. 3 generally illustrates the relationship between work roll diameter and the relative sizes of the compression and tension areas imparted by a work roll on the strip material 100. In general, as the diameter of a work roll decreases, the ratio of the tension surface area (i.e., the surface area of the strip material 100 farthest from the work roll) to the compression surface area (i.e., the surface area of the strip material 100 closest to the work roll) increases. Thus, smaller diameter work rolls can impart greater stresses to the strip material 100 at any given wrap angle.

The practical limits to the reduction of the workroll diameter are mechanical. At some point, the work rolls 200 became too small to transmit the torque required to work the strip material 100. Another consideration is the ability of the workroll 200 to span the gap between backup bearings without significant deflection. Because of these and other mechanical limitations, material conditioners (e.g., levelers) are typically designed to have a variety of work roll diameters. For any given work roll diameter, the thinnest material that can be effectively worked is limited by the relationship of the workroll diameter to the strip material thickness and the resulting ability to create tension on the outer surface of the strip material 100 by wrapping the strip material 100 around that diameter. The thickest strip material 100 is limited by the mechanical strength constraints of the work rolls 200, backup bearings (discussed in detail below), drive train and the force the frame and adjustment system can apply to the strip material 100.

Figure 4:
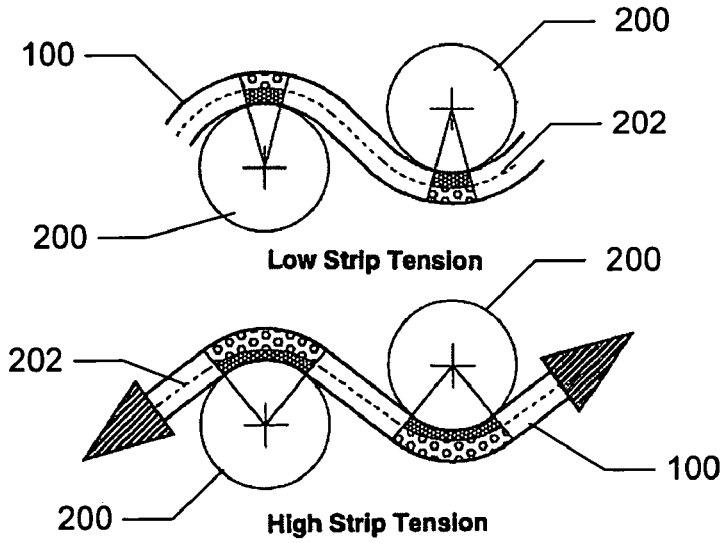
FIG. 4 illustrates the effect of strip material tension on plastic deformation of a strip material.

A leveler (i.e., a particular type of material conditioner) typically nests a series of work rolls 200 resulting in a material path that wraps above and below alternating work rolls 200. Without strip tension, the strip material 100 would bridle around the work rolls 200 (as shown in FIG. 4) with the neutral axis 202 at its center dividing areas of minimal compression and minimal tension. As tension is increased, the neutral axis 202 moves from the center of the strip material 100 toward the surface of the work roll 200, thereby significantly increasing the area of tensile stress causing greater plastic deformation of the strip material 100.

Three things happen as a result of having multiple work rolls 200 in a leveler. First, multiple work rolls 200 allows for multiple passes. This results in more opportunity to yield the strip material 100. Second, by alternately passing the strip material 100 over and under the work rolls 200, the stresses are equalized at the upper and lower surfaces of the strip material 100. This facilitates production of a flat strip material 100 that is relatively free of pockets of distortion. Third, alternating work rolls 200 allows strip tension to be controlled. The surface friction of the bridle path creates strip tension. The control and selective application of that tension allows the strip material 100 to be stretched as it passes through the leveler. By careful control of the path length, the strip material 100 can be selectively stretched, producing desired changes in the shape or condition of the strip material 100.

Figure 5:
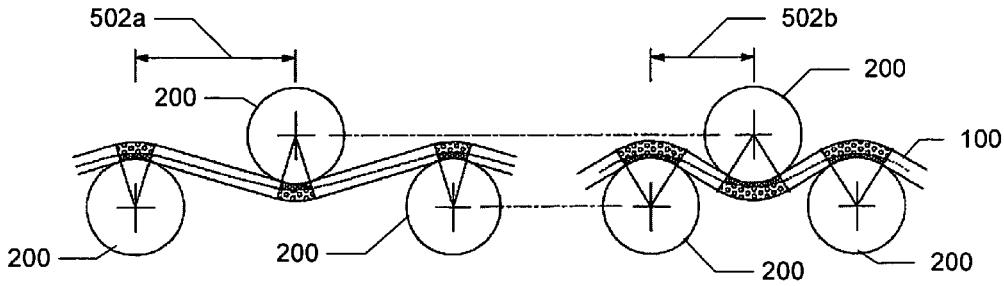
FIG. 5 illustrates the manner in which decreasing the horizontal center distance between work rolls for a given work roll plunge increases the tensile stress imparted to a strip material.

FIG. 5 illustrates the manner in which decreasing a horizontal center distance 502 between work rolls for a given work roll plunge (i.e., the vertical center separation or distance) increases the tensile stress imparted to the strip material 100.

In general, for any given work roll plunge, a decreased horizontal center distance 502 increases the tensile stress imparted to the strip material 100 and, thus, the potential for plastic deformation which, when properly controlled, improves the ability to condition the strip material 100.

Figure 6:
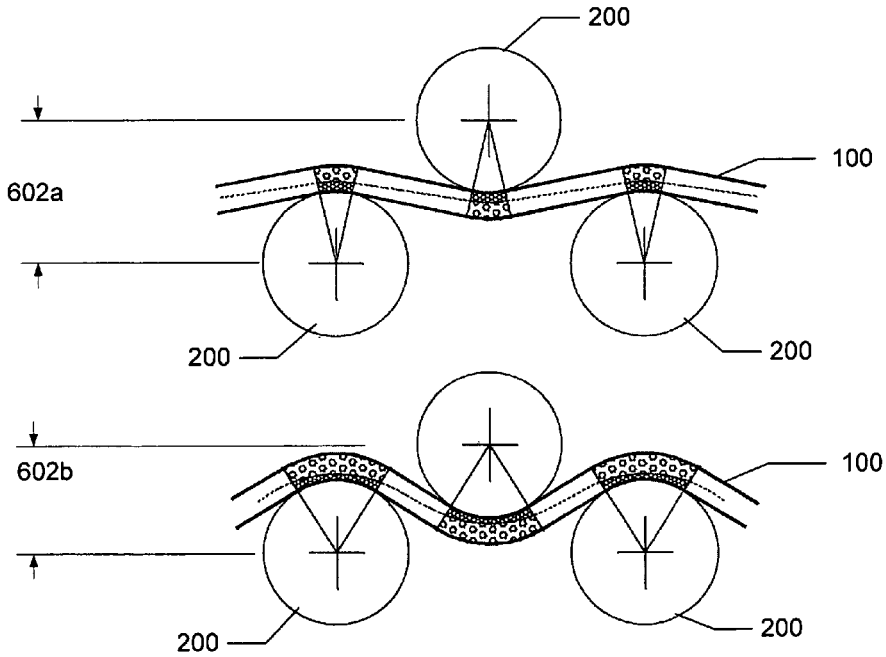
FIG. 6 illustrates the manner in which increasing the plunge for a given horizontal work roll center distance increases tensile stress imparted to the strip material.

FIG. 6 illustrates the manner in which increasing the plunge (i.e., decreasing a vertical center distance 602 between work rolls) for a given work roll horizontal center distance increases tensile stress imparted to the strip material 100. Typically, an operator and/or a control system (discussed in detail below) controls the strip tension through the selective application of the work roll plunge 602. As illustrated in FIG. 6, for a given horizontal center distance, an increased plunge 602 (i.e., a smaller vertical center distance) increases tensile stress in the strip material 100 and, thus, increases the potential for plastic deformation.

In a flattener, which is another type of material conditioner, the centers of all of the work rolls 200 are typically held parallel at all times. The upper work rolls 200 are plunged into the lower work rolls 200 to cause a wave-like bridle effect as the strip material 100 passes through the flattener. The shorter surface of the strip material 100 is stretched slightly down its length and uniformly across its width.

Most of the work is done in the first few workroll clusters with feathering to a flat finish occurring throughout the rest of the flattener.

Flattener work rolls 200 are normally mounted in journal end bearings.

Occasionally, non-adjustable center support backup bearings are added to minimize deflection of the center of the work rolls 200. The work rolls 200 used in a flattener are typically large in diameter and have widely spaced centers. Flatteners are typically used to remove undesirable strip material conditions such as coil set and crossbow. However, flatteners are not equipped with adjustable backup bearings to provide differential leveling or conditioning, which is needed to eliminate other types of material conditions, including waves and buckles that may occur along one or more longitudinal regions or zones of a strip material. On the other hand, a leveler (a type material conditioner described above) may be used to perform such differential conditioning, as well as the simple flattening operations that are performed by flatteners.

Figure 7:
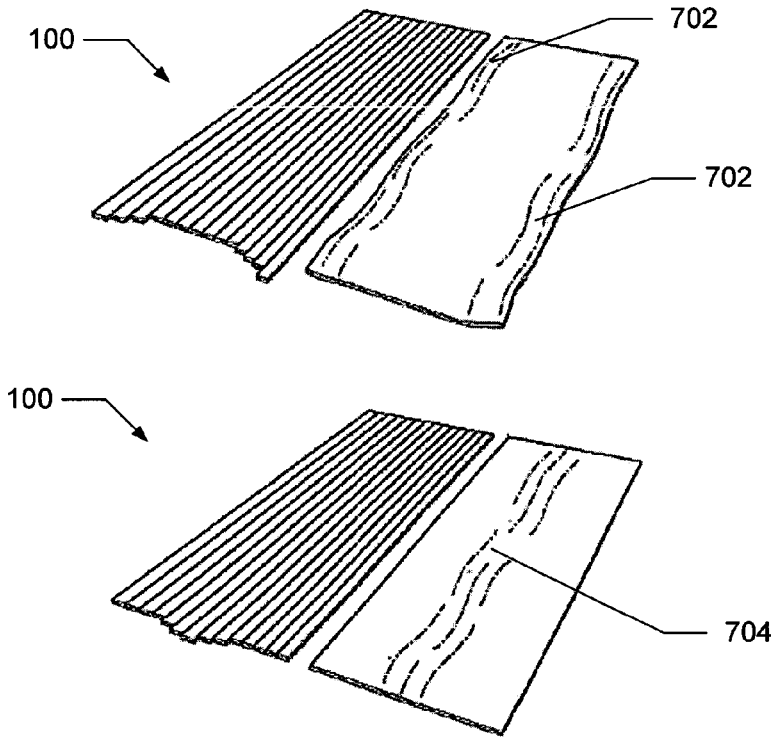
FIG. 7 generally illustrates that portions of a strip material associated with relatively wavy and/or buckled areas are longer than portions of the strip material associated with relatively flat areas.

The cold reduction process may produce metallic strip material that has a non-uniform thickness across its width. If the strip material 100 having such a non-uniform thickness across its width were pulled from a coil and slit into many parallel strands down its length and flattened, the strips from the wavy or buckled areas of the strip material 100 would be longer than the strips from the flat areas of the strip material 100. FIG. 7 illustrates this by aligning one end of the strips. A material conditioner (e.g., a leveler) may be used to stretch the short lengths to approximately match the long lengths of the strip material 100, thereby substantially flattening the strip material 100. If the non-uniform thickness is the result of deflection or crown in the cold reduction rolls, the relatively thin areas of the strip material 100 will be longer (down the length of the coil) than the thick areas of the strip material 100.

These thin areas result in a wave 702 if, near the edge of the strip material 100, or a buckle 704 (or multiple buckles) if captured in the center of the strip material 100.

Unlike a flattener, all of the work roll centers of a leveler are not intended to be held parallel. The work rolls 200 of a leveler typically have a relatively small diameter to provide a high tension surface to compression surface ratio. The small diameter of leveler work rolls 200 in a leveler also allows the work rolls 200 to flex under load. Typically, the centers of the top work rolls 200 of a leveler are held in a co-axial relationship, but the centers of the bottom work rolls 200 of the leveler are not necessarily held in such a co-axial relationship.

Figure 8:
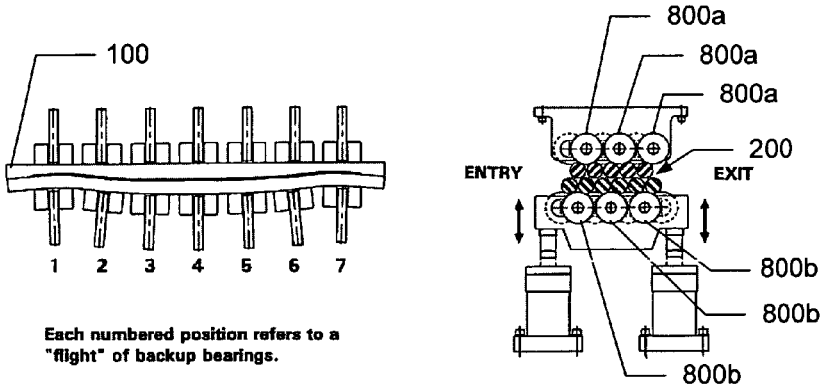
FIG. 8 generally illustrates an example manner in which backup bearings may be used to support work rolls.

FIG. 8 generally illustrates an example manner in which backup bearings 800 may be used to support the work rolls 200. In some material conditioners, such as a leveler, the work rolls 200 are small in diameter and must be backed up along their length to prevent unwanted deflection. As depicted in FIG. 8, top work rolls 200 are typically backed up rigidly with non-adjustable flights of bearings 800*a*. Bottom work rolls 200 may be supported with a series of adjustable backup bearings 800*b* mounted below the work rolls 200 and set on the same spacings as the upper backup bearings 800*a*. By adjusting the bottom backup bearings 800*b* differently across the width of the work rolls 200, differential conditioning across the width of the strip material 100 may be achieved. Each numbered position in FIG. 8 corresponds to a flight of backup bearings.

Figure 9:
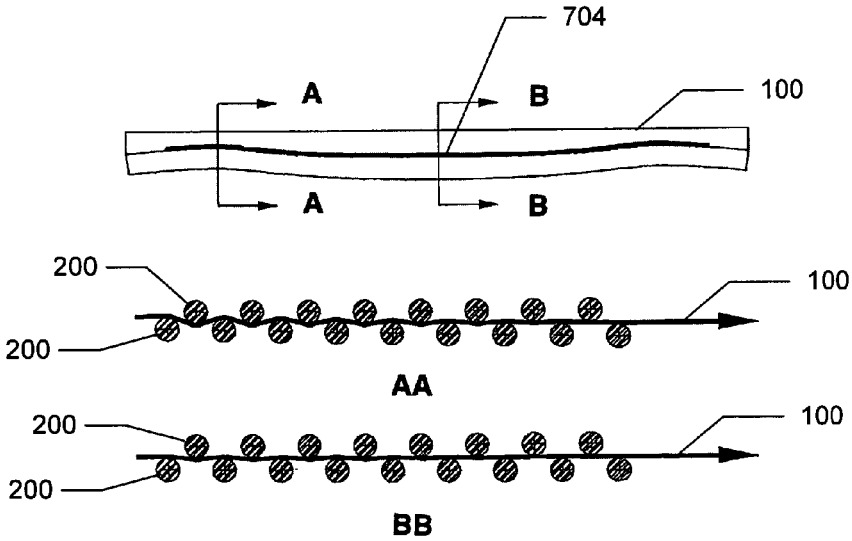
FIG. 9 illustrates an example manner in which work rolls may be set to flatten a strip material having a buckled region or zone.

As discussed above, the strip material 100 having the center buckle 704 is longer in the center of the strip material 100 than on the edges of the strip material 100. If the outermost flights of the backup bearings 800 are set to have more plunge 602 (i.e., a smaller vertical work roll center distance or separation) than the center flights of backup bearings 800, the strip material 100 will follow a longer path at its edge than at its center (see FIG. 9). The strip material 100 may be stretched if tensile stress exceeding the yield strength of the strip material 100 is imparted to the strip material 100 (i.e., plastic deformation). If the path is longer at the edges (i.e., the peripheral regions or zones) of the strip material 100, the leveler will stretch or lengthen the peripheral regions or zones (i.e., the outermost edges) of the strip material. In this manner, the leveler may be used to stretch the peripheral regions or zone of the strip material 100 to a length that approximately matches the length of the central longitudinal region or zone of the strip material 100. When this is done, the coil set is removed, and the strip material 100 will be conditioned to be substantially flat. Of course, the backup bearings 800 may be set in different manners to achieve any other desired material condition (i.e., other than substantial flatness).

Figure 10:
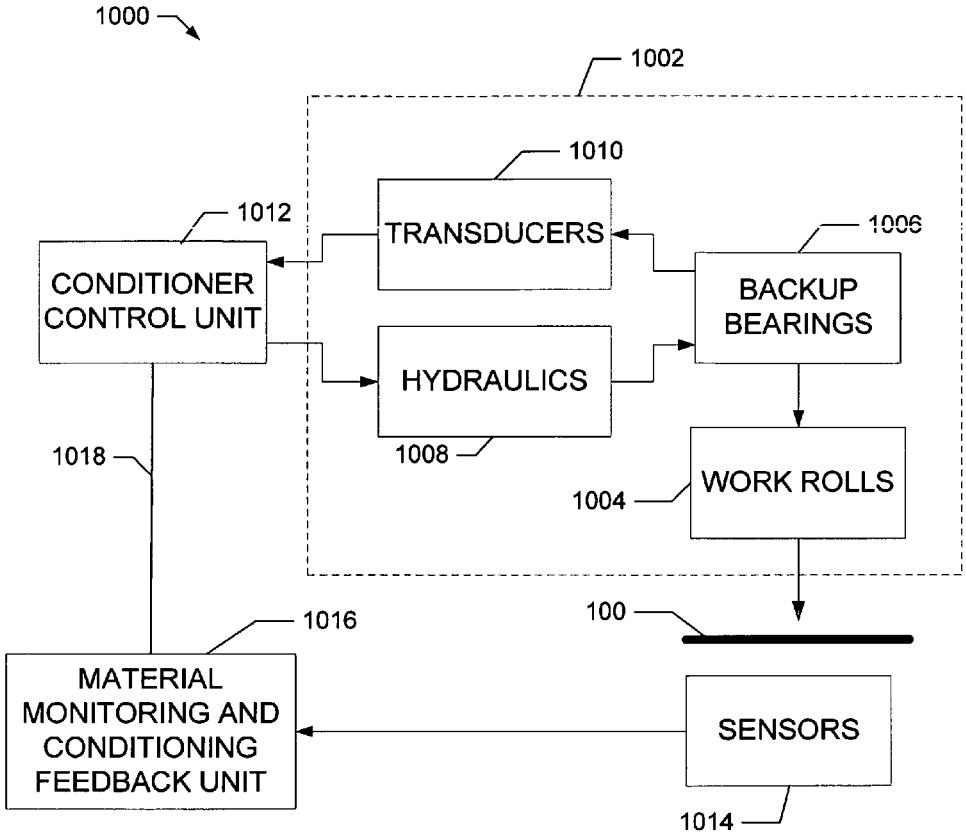
FIG. 10 is a block diagram of an example system for automatically monitoring and conditioning strip material.

FIG. 10 is a block diagram of an example system 1000 for automatically monitoring and conditioning the strip material 100. As set forth in greater detail below, the example system 1000 may be used to condition strip material pulled from, for example, a coil of the strip material, to achieve a desired material condition. For example, the example system 1000 may be used to substantially flatten or level the strip material 100, thereby substantially eliminating material conditions such as, for example, coil set, crossbow, waves and/or buckles extending along one or more longitudinal regions or zones (e.g., outer edges, mid-edges, etc.) of the strip material 100. Alternatively or additionally, the example system 1000 may be used to achieve any other desired non-flat material condition. More specifically, the example system 1000 uses a plurality of sensors to develop topographic data representing the deviations of the surface of the strip material 100 from a desired condition, or predetermined zero point (e.g., a flat condition). The topographic data is developed across the width and along the length of the strip material 100. The topographic data may then be used to automatically adjust settings on a material conditioner to achieve the desired material condition. Additionally or alternatively, the topographic data may be used to develop certification information related to one or more material conditions (e.g., flatness) for predetermined quantities of the strip material (e.g., a sheet, a bundle of sheets, etc.) of the strip material 100. The system 1000 may be integrated with a material conditioner, or may alternatively be retrofitted to monitor an established material conditioner. Similarly, the system 1000 may be located proximate the material conditioner, e.g., in a hazardous area, or may alternatively be located remotely from the material conditioner, e.g., in a non-hazardous area.

Now turning in detail to FIG. 10, the example system 1000 may include a material conditioner 1002. For the example system 1000 described herein, the material conditioner 1002 is described as being a leveler, which is a well known type of material conditioner. However, those of ordinary skill in the art will readily appreciate that other types of material conditioners could be used instead. For example, the apparatus and methods described herein could be advantageously applied to a flattener or to other types of rollforming equipment.

As shown in FIG. 10, the material conditioner 1002 may include work rolls 1004 that are supported by backup bearings 1006. Some of the backup bearings 1006 may be non-adjustable or relatively fixed in place, thereby fixing the ones of the work rolls 1004 supported by those non-adjustable ones of the backup bearings 1006 in place. Other ones of the backup bearings 1006 may be adjustable, thereby enabling the ones of the work rolls 1004 supported by the adjustable ones of the backup bearings 1006 to be adjusted or moved relative to the fixed ones of the work rolls 1004. Adjustment of the movable ones of the work rolls 1004 may enable substantially continuous or stepwise variation of the plunge of the work rolls 1004, thereby enabling a substantially continuous or stepwise variation of the stress imparted to the strip material 100. Preferably, but not necessarily, the movable or adjustable ones of the backup bearings 1006 are arranged in independently movable or adjustable flights. In this manner, the plunge and, thus, the stress imparted to the strip material 100 can be varied across the width of the strip material 100. Varying the stresses applied to the strip material 100 across its width, enables the performance of the material conditioning operations described in greater detail below in which the stresses applied to the material may be varied as needed within different longitudinal regions or zones of the strip material and over time to achieve a desired material condition.

The backup bearings 1006 may be actuated using hydraulics 1008 and the position or location (e.g., the plunge) of the backup bearings 1006 may be sensed by transducers 1010. The transducers 1010 may include linear voltage displacement transformers (LVDTs) or any other suitable position sensing device or combination of devices. A conditioner control unit 1012 is communicatively coupled to the hydraulics 1008 and the transducers 1010. The conditioner control unit 1012 receives the backup bearing position or location information from the transducers 1010 and sends commands or other signals to the hydraulics 1008 to cause the adjustable ones of the backup bearings 1006 to be moved to a desired location, position, plunge setting, etc.

As the strip material 100 is processed by the material conditioner 1002, the sensors 1014 detect changes in the condition (e.g., deviations from the flat condition) of the strip material 100, both across its width and along its length as the strip material 100 moves through the material conditioner 1002. As described in greater detail below in connection with FIG. 11, the sensors 1014 may include a plurality of distance sensors spaced across the width of the strip material 100 such that each of the distance sensors corresponds to a particular longitudinal region or zone of the strip material 100. For example, the regions or zones may be peripheral or outer edges, mid-edges, a center portion, etc. of the strip material 100.

The sensors 1014 may also include one or more length or travel sensors that provide information related to the amount or length of the strip material 100 that has passed through the work rolls 1004. In this manner, the deviation information collected by the sensors 1014 can be associated with locations along the length of the strip material 100, thereby enabling generation of topographical data related to the condition of the strip material 100.

The sensors 1014 are communicatively coupled to a material monitoring and conditioning feedback (MMCF) unit 1016 that processes signals or information received from the sensors 1014 such as, for example, material condition deviation information and length information (e.g., the amount of the strip material 100 that has passed through the work rolls 1004) to generate topographical data associated with one or more conditions of the strip material 100. The MMCF unit 1016 may then use the topographical data to generate corrective feedback information that is conveyed via a communication link 1018 to the conditioner control unit 1012. The conditioner control unit 1012 may use the corrective feedback information to make adjustments to the work rolls 1004 via movements of the hydraulics 1008 and the backup bearings 1006 to achieve a desired material condition for the strip material 100. For example, the MMCF unit 1016 may generate corrective feedback information to achieve a substantially flat condition for the strip material 100.

Alternatively or additionally, the MMCF unit 1016 may generate certification information such as, for example, flatness information for predetermined quantities of the strip material 100. For example, the MMCF unit 1016 may use the topographical information or data to generate flatness data for each cut sheet of the strip material 100 and, for each bundle of sheets, may generate certification information to be associated with the bundles by, for example, applying a label containing the certification information to each of the bundles.

The communication link 1018 may be based on any desired hardwired media, wireless media, or any combination thereof. In addition, any suitable communication scheme or protocol may be used with the link 1018. For example, the link 1018 may be implemented using an Ethernet-based platform, telephone lines, the Internet, or any other platform using any desired communication lines, network and/or protocol.

Although the example system 1000 depicts the conditioner control unit 1012 and the MMCF unit 1016 as being separate units that are communicatively coupled via the link 1018, the functions performed by the units 1012 and 1016 could be combined into a single device if desired. However, in some cases separation of the functions performed by the units 1012 and 1016 may be advantageous. For example, a separate MMCF unit 1016 may be easily retrofit to existing material conditioners and conditioner control units, thereby enabling expensive equipment having substantial useful life to realize the advantages of the apparatus and methods described herein.

Figure 11:
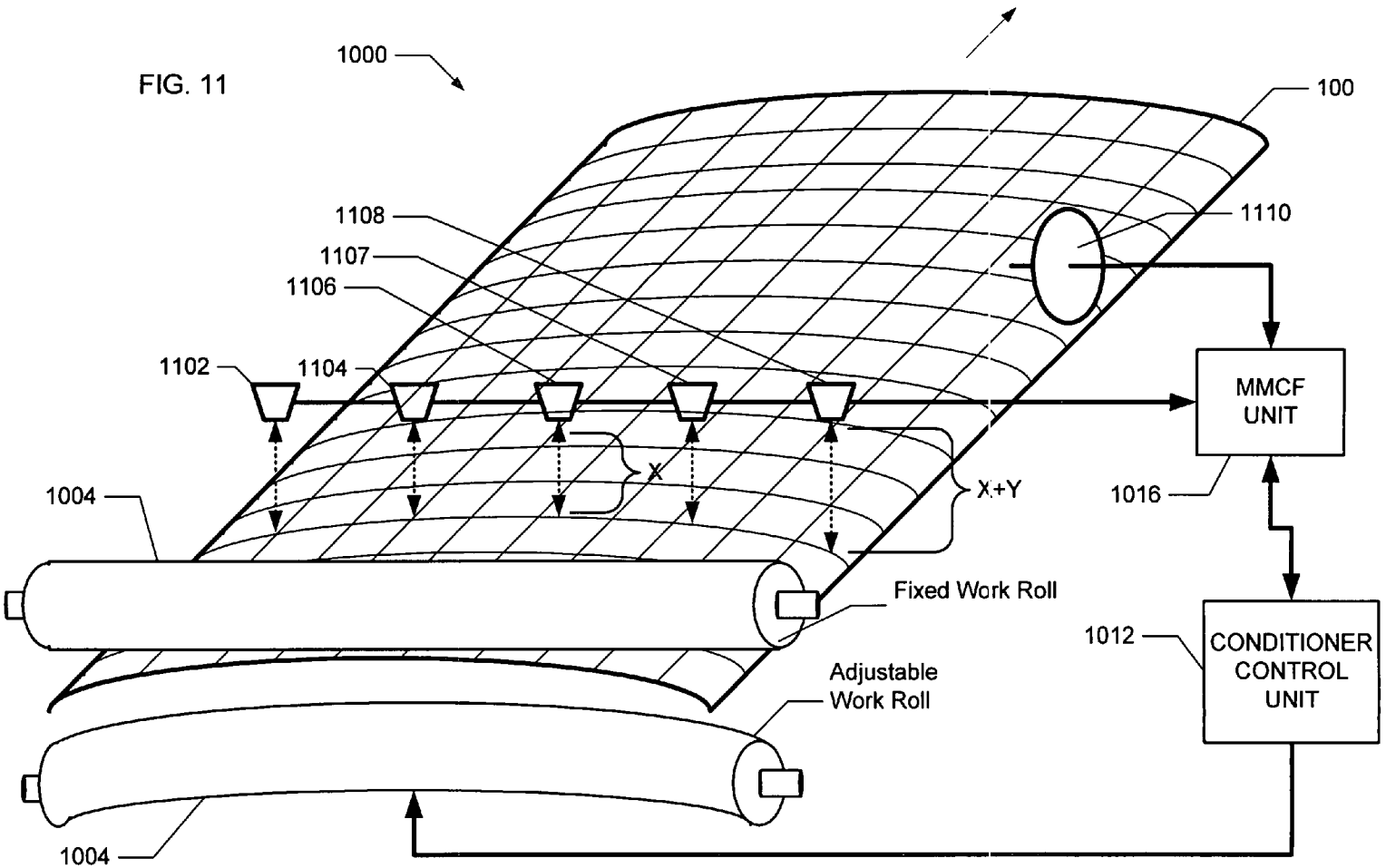
FIG. 11 is a more detailed diagrammatic view of an example manner in which the example system shown in FIG. 10 may be implemented.

FIG. 11 is a more detailed diagrammatic view of an example manner in which the example system 1000 shown in FIG. 10 may be implemented. As depicted in FIG. 11, the strip material 100 passes through the work rolls 1004, one of which is depicted as being fixed and the other of which is depicted as being adjustable. For purposes of clarity, only two work rolls are shown. However, more than two work rolls may be used if desired. A plurality of distance sensors 1102, 1104, 1106, 1107, and 1108 detect the distance to a surface of the strip material 100. The distance sensors 1102-1108 may be implemented using any desired contact and/or non-contact sensor technology or combination of technologies, including capacitive sensors, ultrasonic sensors, laser-based or other optical devices, riding needle sensors, etc.

Regardless of the particular technologies employed by the distance sensors 1102-1108, the sensors 1102-1108 may be calibrated to a predetermined fixed distance using, for example, a known substantially flat surface. Such an absolute calibration enables the distance sensors 1102-1108 to detect material conditions (e.g., crossbow, buckles, waves, etc.) that are evidenced as deviations from a known flat condition across the width and along the length of the strip material 100. For example, the distance sensors 1102-1108 may detect the deviations from the known flat condition and this provides the system with a material profile, such as the wave height of the material.

The example implementation of the system 1000 shown in FIG. 11 depicts five distance sensors (i.e., the sensors 1102-1108) that, starting from the outer edges of the strip material 100, are spaced substantially equally across the width of the strip material 100. However, a different number of distance sensors and different spacing between such distance sensors may be used if desired. Further, it should be understood that while the methods described below in connection with FIGS. 17-25 are based on the MMCF unit 1016 receiving distance or deviation information from five sensors corresponding to five longitudinal regions or zones along the strip material 100, more or fewer sensors and zones or regions may be used instead.

Still further, it should be recognized that there is not necessarily a one-to-one correspondence between the regions or zones associated with the distance sensors 1102-1108 and the adjustment zones or regions across the adjustable ones of the work rolls 100. For example, the material conditioner 1002 (FIG. 10) may have more or fewer sets of adjustable ones of the backup bearings 1006 (FIG. 10) than sensor zones. Thus, the MMCF unit 1016 may map the distance sensors 1102-1108 to adjustable ones of the backup bearings 1006 (FIG. 10) so that each of the five regions or zones defined by the distance sensors 1102-1108 corresponds to at least one adjustable set of the backup bearings 1006 (FIG. 10). In this manner, sensor zones are mapped to material conditioner control zones or regions. For example, a first adjustable flight of the backup bearings 1006 may correspond to a first sensor zone along an outer edge of the material (e.g., the zone associated with the distance sensor 1102), a second adjustable flight of the backup bearings 1006 may correspond to a second sensor zone along a first mid-edge of the strip material (e.g., the zone associated with the distance sensor 1104), a third adjustable flight of the backup bearings 1006 may correspond to a third sensor zone along a center portion of the strip material 100 (e.g., the zone associated with the distance sensor 1106), and so on.

On the other hand, multiples flights of adjustable ones of the backup bearings 1006 may correspond to each of the sensor zones or regions.

Preferably, but not necessarily, the distance sensors 1102-1108 are spaced equally across the width of the strip material 100. However because the width of the strip material 100 processed by the system 1000 may vary over different production runs, the distance sensors 1102-1108 may be moved accordingly and, thus, will not always correspond to the same one or more material conditioner control zones (i.e., adjustable flights of the backup bearings 1006).

As is also depicted in FIG. 11, the example system 1000 includes an encoder 1110 for the purpose of measuring an amount or length of the strip material 100 that has moved through the work rolls 1004. For example, the encoder 1110 may be implemented using a twelve inch encoder wheel that rides on the strip material 100 as the strip material 100 moves. In that case, each time the wheel of the encoder 1110 makes a complete revolution, the strip material 100 has traveled twelve inches. The encoder 110 may be radially divided into a plurality of signal points. For example, if a twelve inch encoder is divided into twelve signal points, the encoder 110 would produce a signal every time the strip material 100 travels one inch. In practice, the encoder 110 may be divided into any number of signal points (e.g., 1200 per revolution).

Thus, by spacing the sensors 1102-1108 across the strip material 100 and periodically taking distance measurements (i.e., at a predetermined time interval) as the strip material 100 is moved through the conditioner 1002, the MMCF 1016 can acquire data indicative of the overall topography of the strip material 100. However, the strip material 100 may be moved through the conditioner 1002 at different rates of speed. As a result, the time between readings of the distance sensors 1102-1108 may not be an accurate indication of distances traveled down the strip material 100. Thus, the length or distance traveled information can be supplied by the encoder 1110 to eliminate the inaccuracies that could otherwise result if the measurement interval time were used to estimate the strip material length between readings of the distance sensors 1102-1108.

Figure 12:
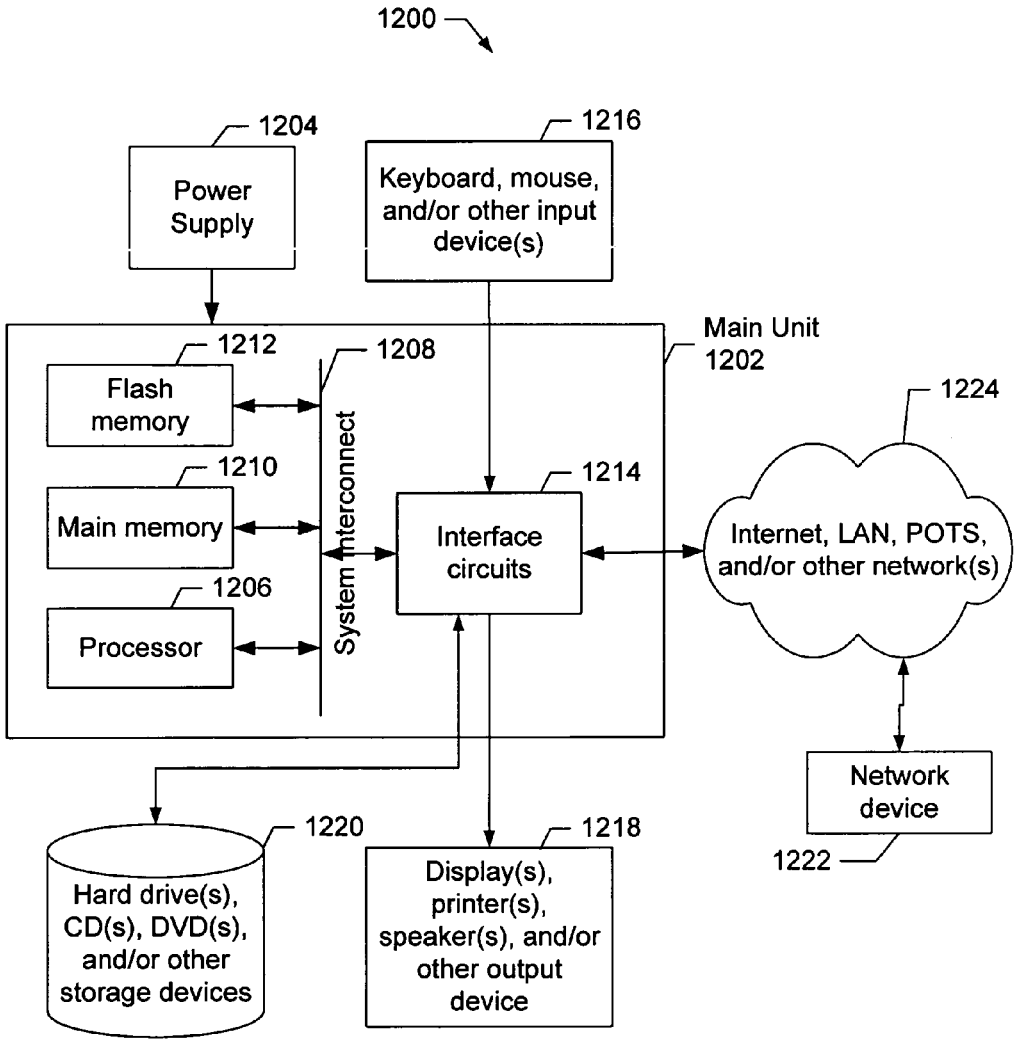
FIG. 12 is a block diagram of an example processor-based system that maybe used to implement one or both of the example conditioner control unit and the material monitoring and conditioning feedback unit shown in FIGS. 10 and 11.

FIG. 12 is a block diagram of an example processor-based system 1200 that maybe used to implement one or both of the example leveler control unit 1012 and the MMCF unit 1016 shown in FIGS. 10 and 11. The example system 1200 may be based on a personal computer (PC) or any other computing device. The example system 1200 illustrated includes a main processing unit 1202 powered by a power supply 1204. The main processing unit 1202 may include a processor 1206 electrically coupled by a system interconnect 1208 to a main memory device 1210, a flash memory device 1212, and one or more interface circuits 1214. In one example, the system interconnect 1208 is an address/data bus. Of course, a person of ordinary skill in the art will readily appreciate that interconnects other than busses may be used to connect the processor 1206 to the other devices 1210-1214. For example, one or more dedicated lines and/or a crossbar may be used to connect the processor 1206 to the other devices 1210-1214.

The processor 1206 may be any type of well known processor, such as a processor from the Intel Pentium® family of microprocessors, the Intel Itanium® family of microprocessors, the Intel Centrino® family of microprocessors, and/or the Intel XScale® family of microprocessors. In addition, the processor 1206 may include any type of well known cache memory, such as static random access memory (SRAM). The main memory device 1210 may include dynamic random access memory (DRAM) and/or any other form of random access memory. For example, the main memory device 1210 may include double data rate random access memory (DDRAM). The main memory device 1210 may also include non-volatile memory.

In an example, the main memory device 1210 stores a software program which is executed by the processor 1206 in a well known manner. The flash memory device 1212 may be any type of flash memory device. The flash memory device 1212 may store firmware and/or any other data and/or instructions.

The interface circuit(s) 1214 may be implemented using any type of well known interface standard, such as an Ethernet interface and/or a Universal Serial Bus (USB) interface. One or more input devices 1216 may be connected to the interface circuits 1214 for entering data and commands into the main processing unit 1202. For example, an input device 1216 may be a keyboard, mouse, touch screen, track pad, track ball, isopoint, and/or a voice recognition system.

One or more displays, printers, speakers, and/or other output devices 1218 may also be connected to the main processing unit 1202 via one or more of the interface circuits 1214. The display 1218 may be a cathode ray tube (CRT), a liquid crystal displays (LCD), or any other type of display. The display 1218 may generate visual indications of data generated during operation of the main processing unit 1202, as described herein below. The visual indications may include prompts for human operator input, calculated values, detected data, etc. Additionally, the display 1218 and/or system 1200 may be located in any number of locations relative the example leveler control unit 1012 or the MMCF unit 1016, including either local or remote. For instance, the display 1218 and/or system 1200 may be operatively connected to either the leveler control unit 1012 and/or the MMCF unit 1016 such that the display 1218 and/or system 1200 is remotely located from the leveler control unit 1012 and/or the MMCF unit 1016 in, for example, a non-hazardous zone.

The example system 1200 may also include one or more storage devices 1220. For example, the example system 1200 may include one or more hard drives, a compact disk (CD) drive, a digital versatile disk drive (DVD), and/or other computer media input/output (I/0) devices.

The example system 1200 may also exchange data with other devices 1222 via a connection to a network 1224. The network connection may be any type of network connection, such as an Ethernet connection, digital subscriber line (DSL), telephone line, coaxial cable, etc. The network 1224 may be any type of network, such as the Internet, a telephone network, a cable network, and/or a wireless network.

The network devices 1222 may be any type of network devices. For example, the network device 1222 may be a client, a server, a hard drive, etc., including another system similar or identical to the example system 1200. More specifically, in a case where the MMCF unit 1016 and the conditioner control unit 1012 are implemented as separate devices coupled via the link 1018, one of the units 1012 and 1016 may correspond to the example system 1200, the other one of the units 1012 and 1016 corresponds to the network device 1222 (which may also be implemented using a system similar or identical to the system 1200), and the link 1018 corresponds to the network 1224.

FIGS. 13-25 described in detail below an example manner in which the example system 1000 of FIG. 10 may be configured to produce certification data or information for the strip material 100 and/or to adjust a material conditioner (e.g., the example material conditioner 1002 of FIG. 10) to achieve a desired material condition (e.g., a substantially flat condition) for the strip material 100. Preferably, the methods depicted in FIGS. 13-25 are embodied in one or more software programs or instructions that are stored in one or more memories and executed by one or more processors (e.g., processor 1206 of FIG. 12) in a well known manner. However, some or all of the blocks shown in FIGS. 13-25 may be performed manually and/or by another device. Additionally, although the methods depicted in FIGS. 13-25 are described with reference to a number of example flow diagrams, a person of ordinary skill in the art will readily appreciate that many other methods of performing the methods described therein may be used. For example, the order of many of the blocks may be altered, the operation of one or more blocks may be changed, blocks may be combined, and/or blocks may be eliminated.

Figure 13:
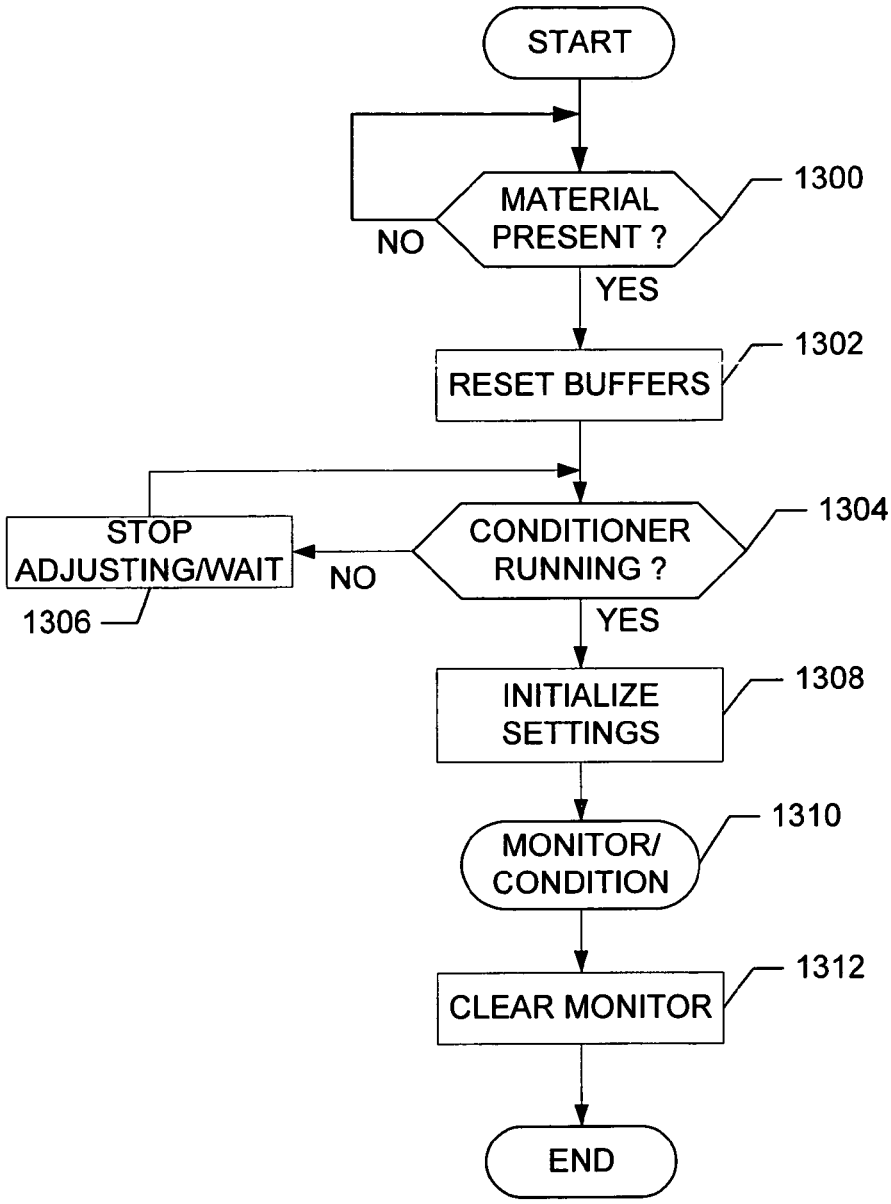
FIG. 13 is flow diagram generally depicting an example manner in which the example material monitoring and conditioning feedback unit of FIGS. 10 and 11 may be configured.

Now turning in detail to FIG. 13, a flow diagram generally depicts an example manner in which the example system 1000 of FIG. 10 may be configured.

Initially, the system 1000 (FIG. 10) determines if strip material is present in the material conditioner 1002 (block 1300). The presence of the strip material 100 may be detected using the sensors 1014 (e.g., the distance sensors 1102-1108 and/or the encoder 1110 shown in FIG. 11) or may be detected in some other manner via the conditioner control unit 1012. If the presence of the strip material 100 is not detected, the system 1000 remains at block 1300.

On the other hand, if the system 1000 detects the presence of the strip material 100 at block 1300, the system 1000 resets data buffers containing, for example, data that may have been previously obtained from the sensors 1014 and/or random data that may be present in the data buffers following a power-up operation or the like (block 1302). The data buffers may be located within the MMCF unit 1016 and, in particular, in the case where the MMCF unit 1016 is implemented using a processor-based system such as the example processor-based system 1200 shown in FIG. 12, the data buffers may be implemented within one or more of the flash memory 1212, the main memory 1210 and/or the processor 1206.

Following the reset of the data buffers at block 1302, the system 1000 may then determine if the material conditioner 1002 is operational or running (block 1304). Such a determination may be made using, for example, the sensors 1014. In particular, time-based variations in readings (e.g., time-varying distance, deviation and or length values or signals) would normally indicate that the strip material 100 is moving through the material conditioner 1002. In particular, time-variant information supplied by the encoder 1110 (FIG. 11) and/or the distance sensors 1102-1108 (FIG. 11) would be indicative of movement of the strip material 100 through the material conditioner 1002 (FIG. 10). Of course, other methods of detecting the movement of the strip material through the material conditioner 1002 could be used instead.

If the material conditioner 1002 is not operational or running at block 1304, the system 1000 stops adjusting the settings of the material conditioner 1002 and/or waits (block 1306). On the other hand, if the material conditioner 1002 is operational or running at block 1304, control is passed to block 1308. At block 1308 the system 1000 initializes the settings associated with the conditioner control unit 1012 and the material conditioner 1002. Such an initialization may involve receiving information associated with the strip material 100 such as, for example, material type information, material thickness information, etc. An operator may enter such material information via, for example, one or more of the input devices 1216 (FIG. 12), which may be communicatively coupled to one or both of the MMCF unit 1016 and the conditioner control unit 1012. The material information may, in turn, be used to select appropriate default settings (e.g., work roll plunge, adjustable work roll profile and/or backup bearing height settings, etc.) for the material conditioner 1002. Such default settings may be stored in one or both of the MMCF unit 1016 and the conditioner control unit 1012.

Once the conditioner settings have been initialized at block 1308, the system 1000 may then monitor the condition of the strip material 100 for the purpose of generating certification data and/or for the purpose of adjusting the material conditioner 1002 to achieve a desired material condition (e.g., a substantially flat condition) (block 1310). For example, the system 1000 may collect and store the monitored information and print a label indicating the material conditions encountered. The label may indicate the flatness of the metal by identifying the highest point measured in the bundle by each sensor, the average height for the whole bundle, and/or any other suitable directly measured or calculated condition. The collected and monitored data may allow a supplier to grade the product and determine the quality being sold to the customer. For instance, material that is ultimately cut by a laser torch oftentimes has a flatness requirement more stringent than material used with shear or bending operational equipment. At the conclusion of the monitor/condition process (block 1310), control is returned to block 1312, at which the monitored information (e.g., the data buffers, displayed data, etc.) may be cleared prior to a cessation of operations.

Figure 14:
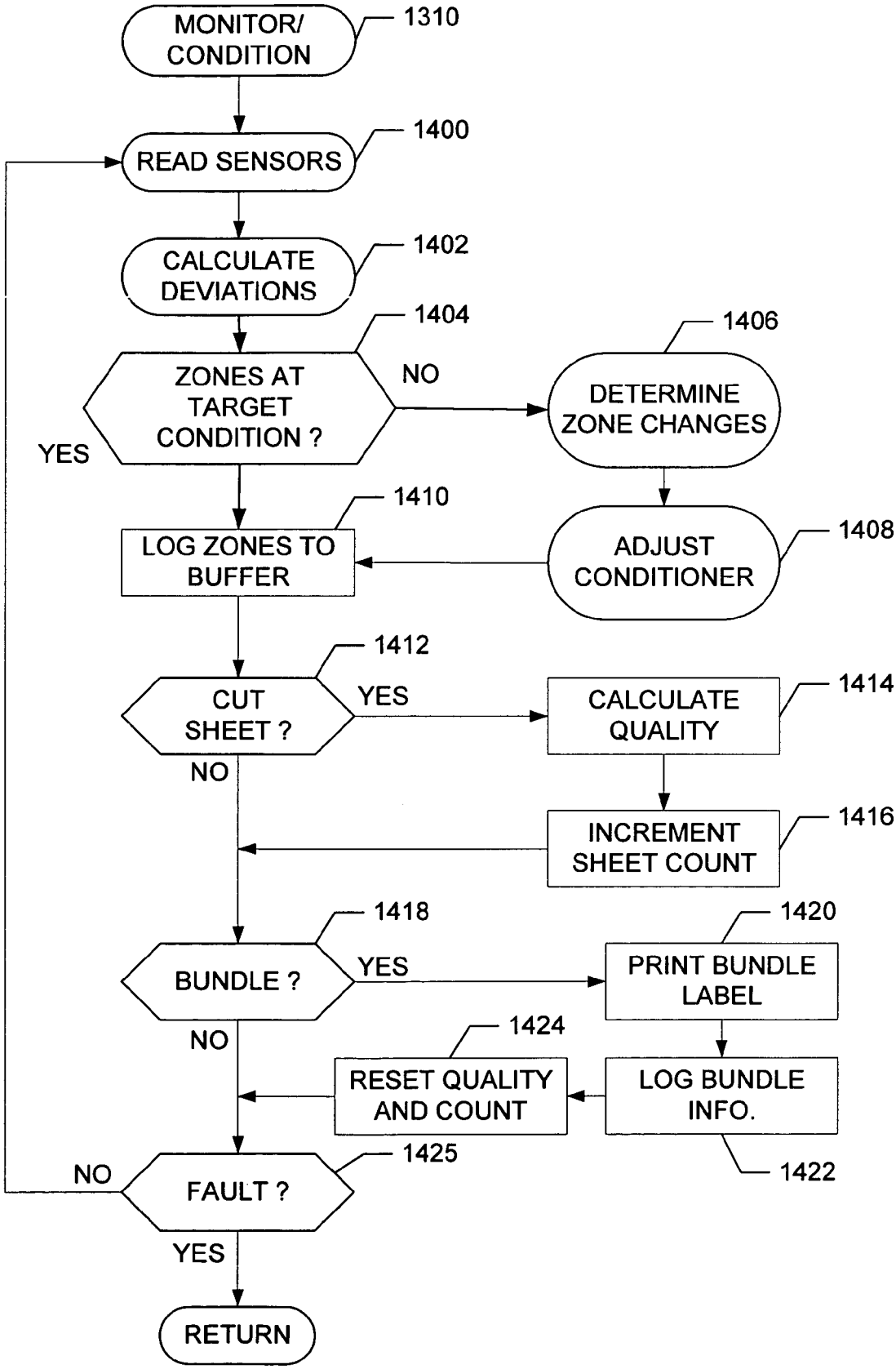
FIG. 14 is a more detailed flow diagram depicting one manner in which the monitor/condition method of FIG. 13 may be implemented.

FIG. 14 is a more detailed flow diagram depicting one manner in which the monitor/condition method (depicted as block 1310 of FIG. 13) may be implemented.

Upon starting the monitor/condition method (block 1310), the system 1000 reads the sensors 1014 (block 1400). In particular, distance or deviation information may be read from the distance sensors 1102-1108 (FIG. 11) at predetermined time intervals so that multiple sets of data are collected from the sensors 1102-1108 at block 1400.

Likewise, linear distance or travel length information or data may be received from the encoder 1110 (FIG. 1) during each time at which distance information or data is collected from the distance sensors 1102-1108. A more detailed description of the manner in which the sensors 1014 may be read at block 1400 is provided in connection with FIG. 15 below.

After the sensor data is read or collected at block 1400, the system 1000 calculates deviations in the collected data (block 1402). In particular, the system 1000 may calculate distance value variations within each of the longitudinal zones or regions of the strip material 100 as well as variations between the zones or regions. A more detailed discussion of one manner in which such deviations may be calculated and used to determine other parameters indicative of a material condition is provided below in connection with FIG. 16.

After the data deviations have been calculated at block 1402, the system 1000 determines if the zones or regions monitored by the sensors 1014 are substantially equal to a target material condition (block 1404). In particular, the system 1000 may compare the average deviations of the zones to each other and/or to one or more predetermined threshold values to determine if the individual zones are at the desired target condition. For example, if the desired target condition is a substantially flat condition, then the average deviations for each of the zones may be compared to each other (i.e., to determine the degree of similarity between the zones) and/or the average deviations of all of the zones may be compared to a predetermined threshold indicative of a substantially flat condition.

If the system 1000 determines at block 1404 that the zones or regions are not at the desired target conditions, zone changes are then determined at block 1406.

In general, zone changes are generated by comparing the relative material conditions (e.g., the flatness) of the zones monitored by the sensors 1014 (FIG. 10). Certain patterns of material conditions are recognized and appropriate adjustment values for use by the material conditioner 1002 are determined based on the patterns. A more detailed description of one manner in which the five distance sensors 1102-1108 shown in FIG. 11 may be used to adjust five zones or regions of the strip material 100 to achieve a desired material condition is described below in connection with FIGS. 17 and 18.

Once the required zone changes have been determined at block 1406, those changes are then used by, for example, the conditioner control unit 1012 (FIGS. 10 and 11) to adjust the material conditioner 1002 by, for example, varying the profiles of one or more of the work rolls 1004 via the backup bearings 1006 and the hydraulics 1008. In general, the adjustments to the work rolls 1004 may be made in a step-wise fashion based, at least in part, on the degree to which the zones deviate from the desired condition. A more detailed description of one manner in which adjustments to the settings of the material conditioner 1002 may be made is provided below in connection with FIGS. 19-25.

Following the conditioner adjustments at block 1408, or if at block 1404 the system 1000 determines that the zones are substantially equal to their target conditions, the system 1000 logs the zone information or data to the buffer (block 1410). After logging the data in the buffer at block 1410, the system 1000 determines if a sheet of the strip material 100 is to be cut (block 1412). A cut sheet determination may be made based on information from the conditioner control unit 1012.

Regardless of where the cut sheet information or signal is generated, if a sheet is cut, the system 1000 (e.g., the MMCF unit 1016) calculates one or more quality parameters associated with that sheet (block 1414). In particular, as described in greater detail in connection with FIG. 16, the quality parameters may include, for example, one or more I-units values for the sheet. I-units are a well-known measure that represents the degree to which a material deviates from a flat condition. Of course, different or additional quality parameters may be calculated at block 1414.

After calculating the quality parameters at block 1414, the sheet count is incremented at block 1416. Following the incrementing of the sheet count at block 1416 or if a cut sheet is not indicated at block 1412, the system 1000 determines if a sufficient quantity of sheets has been formed to generate a bundle of sheets (block 1418). If the system 1000 determines that a bundle is to be formed at block 1418, the system 1000 prints a bundle label, which is affixed or otherwise associated with the bundle, containing certification information for that bundle. Quality parameters associated with the highest quality sheet and the lowest quality sheet within the bundle may be printed on the label. For example, such quality parameters may include the I-units, which are a well known flatness standard, for each of these sheets. One example manner in which the system 1000 may calculate I-units is described in greater detail below in connection with FIG. 16. After the bundle label is printed, the bundle information including, for example, the quality parameters associated with that bundle (all or some of which may also appear on the bundle label) are logged for possible later retrieval (block 1422). The quality information and the sheet count information stored in the buffer(s) of the system 1000 may then be reset (e.g., set to zero or some other predetermined value) (block 1424).

Following the reset of the quality and count values at block 1424 or if the system 1000 determines at block 1418 that a bundle is not being completed, the system 1000 determines if there is a fault (e.g., a mechanical and/or software failure) (block 1425). If there is no fault at block 1425, control returns to block 1400. On the other hand, if there is a fault at block 1425, then control returns to block 1312 of FIG. 13.

Figure 15:
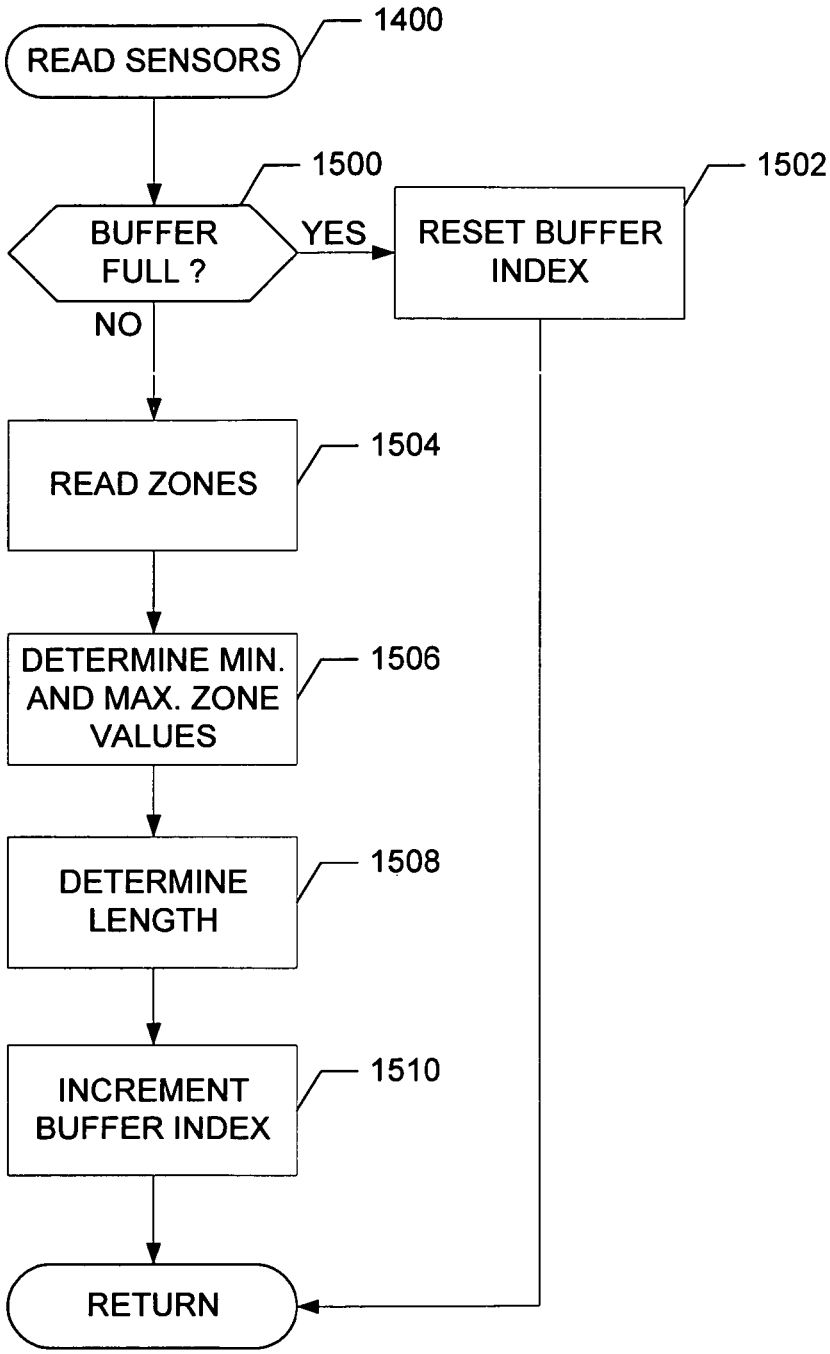
FIG. 15 is a more detailed flow diagram depicting one manner in which the read sensors method of FIG. 14 may be implemented.

FIG. 15 is a more detailed flow diagram depicting one manner in which the read sensors method (block 1400) of FIG. 14 may be implemented. Initially, the system 1000 determines if the data buffer is full (block 1500). If the data buffer is full, the buffer index is reset to a predetermined value (e.g., zero) (block 1502). On the other hand, if the data buffer is not full at block 1500, control is passed to block 1504.

At block 1504, the system 1000 (e.g., the MMCF 1016) reads the zones. In particular, the system 1000 may acquire distance or deviation information from each of the distance sensors 1102-1108 (FIG. 11) and the encoder 1110 (FIG. 11) over a predetermined number of sampling intervals. For example, each of the distance sensors 1102-1108 (FIG. 11) may be polled or read on a periodic basis (i.e., at fixed time intervals or some other predetermined times) by the MMCF unit 1016 (FIG. 11).

The information received by the MMCF unit 1016 may correspond to the individual distances between the sensors 1102-1108 and the upper surface of the strip material 100 underlying the sensors 1102-1108.

Preferably, but not necessarily, the sensors 1102-1108 are calibrated so that the surface of the material conditioner 1002 opposite the sensors 1102-1108 and across which the strip material 100 moves through the material conditioner 1002 (e.g., the tops of the work rolls 1004) is equal to a zero distance or other predetermined distance value. In this manner, any deviation of the material condition of the strip material 100 (e.g., waves, buckles, crossbow, etc.) may be detected as positive (i.e., greater than zero) distance variations across zones (e.g., crossbow) and/or distance variations along one or more of the longitudinal regions or zones of the strip material 100 (e.g., a wave along an edge).

In each instance that zone distance information is read from the sensors 1102-1108 (FIG. 11), length information is read from the encoder 1110 (FIG. 11) and is associated with the distance information. Thus, the zone information (e.g., distance information and length information) may be envisioned as a data table in which each column of the table uniquely corresponds to one of the sensors 1102-1108 and the encoder 1110, and each of the rows represents a sampling event or time. The number of sampling events or times (e.g., rows of data) may be selected to suit the particular needs of a given material monitoring and/or conditioning application. For example, in some applications more than a thousand sampling events may take place at block 1504. However, other applications may require more or fewer sampling events.

After the zone data has been read at block 1504, the system 1000 (e.g., the MMCF unit 1016) determines the minimum and maximum deviation or distance readings within each zone (block 1506). Additionally, the system 1000 may determine the instantaneous and/or the average deviation or distance readings within each zone, or across multiple zones. At block 1508, the system 1000 determines the total length of the strip material 100 that has passed through the conditioner 1002 during the collection of zone data at block 1504. For example, the MMCF unit 1016 (FIG. 11) may determine the change in the count values or other signals received from the encoder 1110 (FIG. 11) and may convert that count value into a length value. For example, in the case where the encoder 1110 is a twelve inch encoder (i.e., has a twelve inch circumference) and outputs a signal or increments its count once per inch traveled, a count change of one hundred indicates that one hundred inches of the strip material 100 have passed through the material conditioner 1002 during the zone readings taken at block 1504. After the length has been determined at block 1508, the system 1000 increments the buffer index (block 1510).

Figure 16:
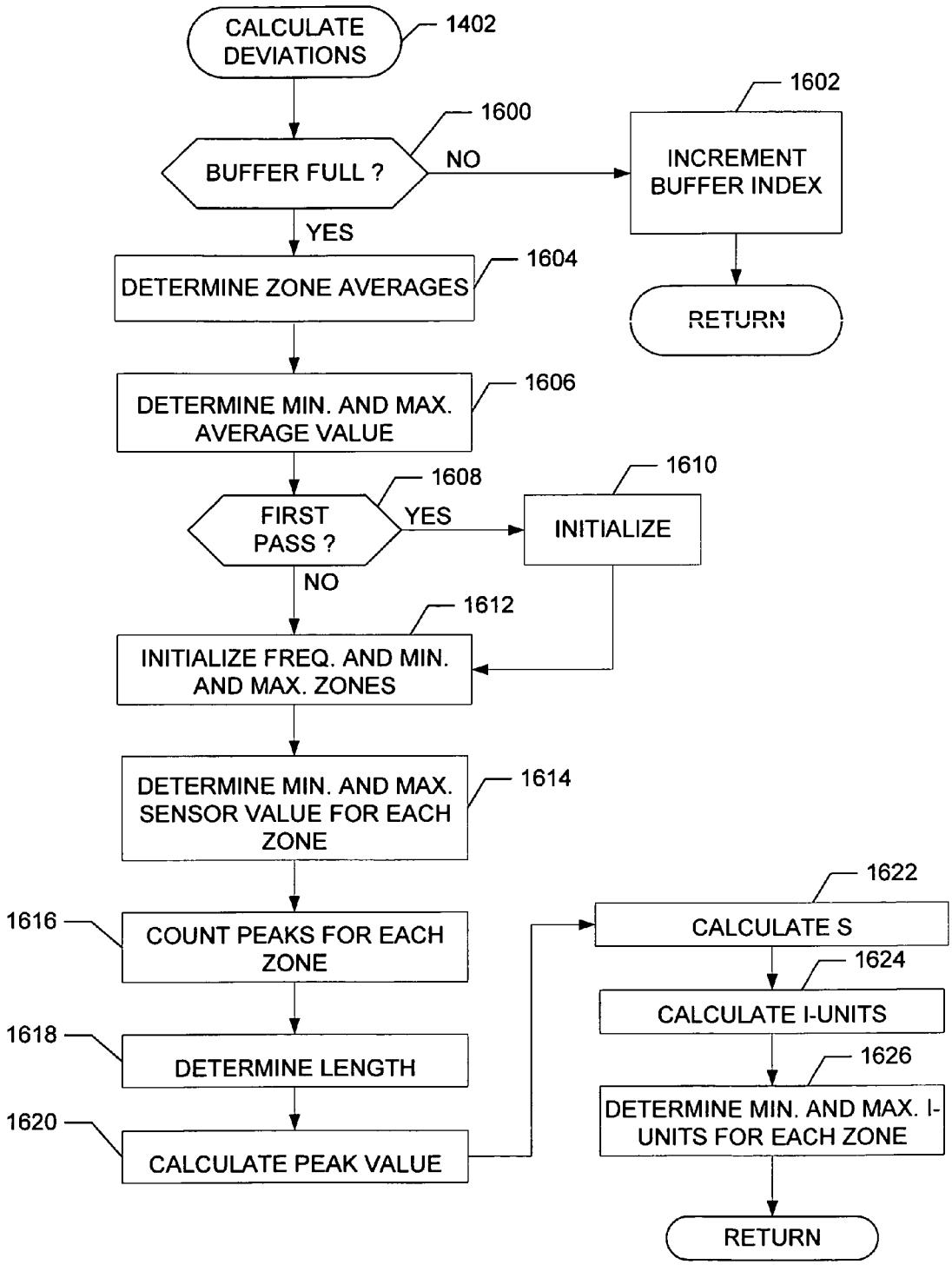
FIG. 16 is a more detailed flow diagram depicting one manner in which the calculate deviations method of FIG. 14 may be implemented.

FIG. 16 is a more detailed flow diagram depicting one manner in which the calculate deviations method (block 1402) of FIG. 14 may be implemented. Initially, the system 1000 (FIG. 10) determines if the buffer is full (block 1600). If the buffer is not full at block 1600, then the system 1000 increments the buffer index (block 1602) and control is passed to block 1404 of FIG. 14. On the other hand, if the buffer is full at block 1600, then control is passed to block 1604.

At block 1604, the system 1000 (e.g., the MMCF unit 1016) determines the average of the deviation or distance values currently stored in the buffer. In the case where the MMCF unit 1016 obtains the deviation or distance information from the distance sensors 1102-1108 and the sensors 1102-1108 are calibrated so that any measured deviations (i.e., distance changes) are positive (i.e., greater than zero) with respect to a surface of the material conditioner 1002 underlying the strip material 100, then the zone averages are representative of the degree to which each zone deviates from a flat or other desired condition. In general, larger average values for a given zone are indicative of a greater deviation from a flat condition within that zone.

While the examples described herein use zone averages to detect, monitor or measure the deviation of the strip material 100 from a substantially flat condition, different or additional statistical proxies could be used if desired. For example, some fraction of the average values could be used, a maximum deviation value(s) could be used, a square root of a sum of squares of deviations could be used, etc.

Furthermore, it should be recognized that, if calibrated in the above-described manner, the distance readings obtained from the sensors 1102-1108 (FIG. 11) would be offset by an amount equal to the thickness of the strip material 100. As a result, in a case where the zone averages are all substantially non-zero and equal to each other and offset from zero by an amount substantially equal to the thickness of the strip material 100, those averages are, indicative of a substantially flat condition.

More generally, as described in greater detail below, a substantially flat condition for the strip material corresponds to a condition in which the averages for all of the zones (e.g., all five zones for the example implementation shown in FIG. 11) are substantially equal.

After the zone averages have been determined at block 1604, the system 1000 may determine the minimum and maximum average values across all zones (block 1606). The system 1000 may then determine if the current calculation of deviations is a first pass (i.e., the first time for the strip material 100 being processed by-the material conditioner 1002) (block 1608). If the system 1000 determines that the current deviation calculations are being made during a first pass at block 1608, the system 1000 performs a first pass initialization (block 1610). Such a first pass initialization may include initialization of variables that require initialization following a system power up or the like. If the current deviation calculations are not part of a first pass (block 1608), then the system 1000 may initialize system variables containing values such as the minimum and maximum deviation or distance readings for each zone, the inverse of the average length between peaks (which is similar to a frequency of the deviations) for each zone, as well as any other variables desired (block 1612).

The system 1000 may then determine the minimum and maximum distance or deviation readings for each of the zones (block 1614). For example, in the case where the five sensors 1102-1108 (FIG. 11) and, thus, five zones, are used, the minimum and maximum readings within the buffer for each of the zones are determined. The number of peaks within each of the zones is then calculated (block 1616). For example, for each zone, peaks may be found by identifying those distance or deviation readings that are preceded and followed by smaller values. Of course, any other desired manner of detecting peak values may be used instead. The length of the strip material 100 corresponding to the zone readings in the buffer is then determined (block 1618). For example, the length may be calculated by subtracting the maximum and minimum encoder readings (e.g., from the encoder 1110 of FIG. 11) and converting the encoder readings difference to a length based on the known characteristics of the encoder 1110 (FIG. 11).

The system 1000 may then calculate the peak value (e.g., the overall wave height) for each of the zones stored in the buffer (block 1620). For example, the peak value for each zone may be determined by multiplying the average value for the zone by two and subtracting the known thickness of the strip material 100. Of course, other methods of calculating a peak value for each zone may be used instead. The system 1000 then calculates an intermediate parameter "S" for each of the zones (i.e., the zone data stored in the buffer) as defined in Equation 1 below (block 1622).

$$S=\text{PeakValue}/\text{Span} \qquad \text{Equation 1}$$

The variable "PeakValue" is the peak value calculated at block 1620 and the variable "Span" is calculated by dividing the length value for each zone (calculated at block 1618) by the number of peaks counted for each zone (calculated at block 1616).

The S parameter for each zone may then be used to calculate the I-units for each zone using the well-known equation set forth below as Equation 2 (block 1624). As is well known, the I-units for a zone are indicative of the shape or flatness of a material zone or region. In general, a lower I-units value corresponds to a higher degree of flatness.

$$I\text{-units}=2.47*S^2*10^5 \qquad \text{Equation 2}$$

After calculating the I-units for each of the zones (i.e., the zone data stored in the buffer), the minimum and maximum I-units for each of the zones are determined (block 1626) and control returns to block 1404 of FIG. 14.

Figure 17:
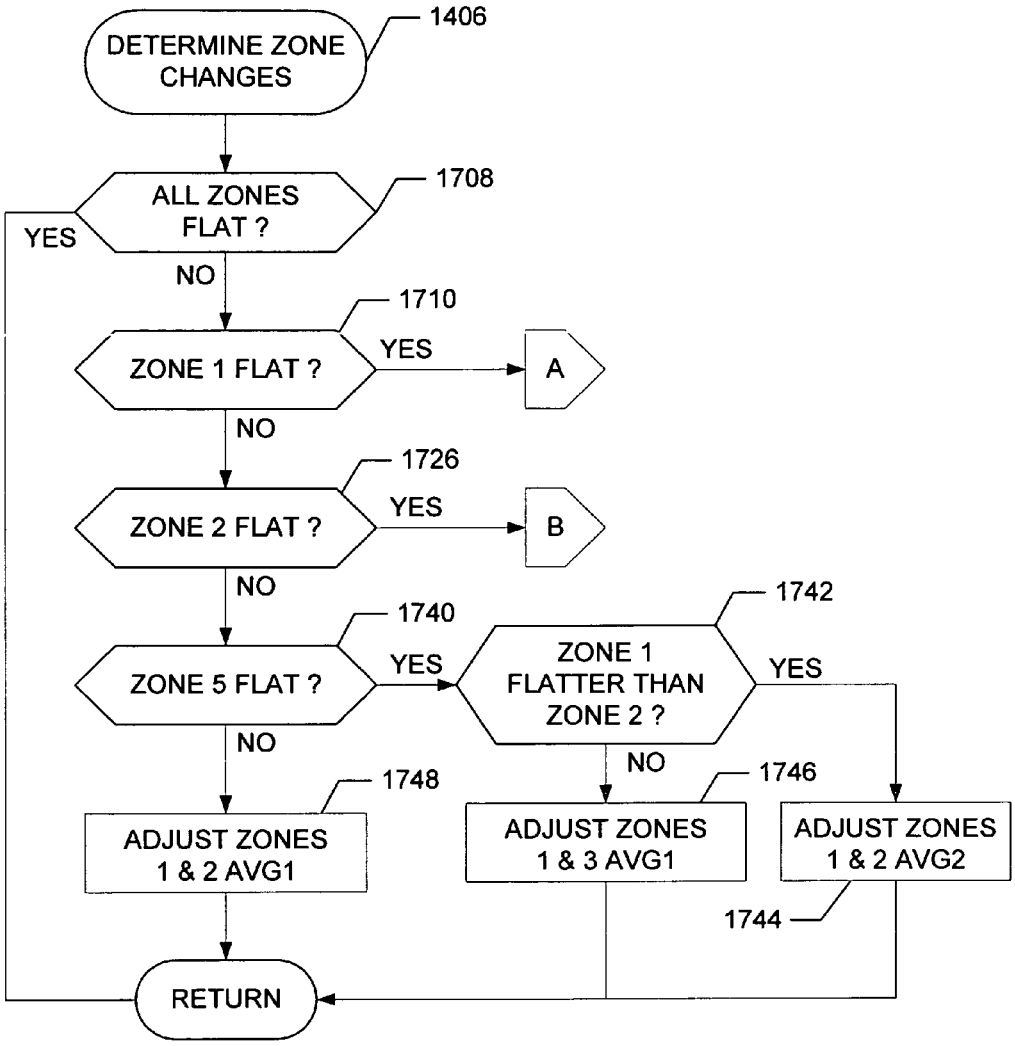
FIGS. 17 and 18 are a more detailed flow diagram depicting one manner in which the determine zone changes method of FIG. 14 may be implemented.
Figure 18:
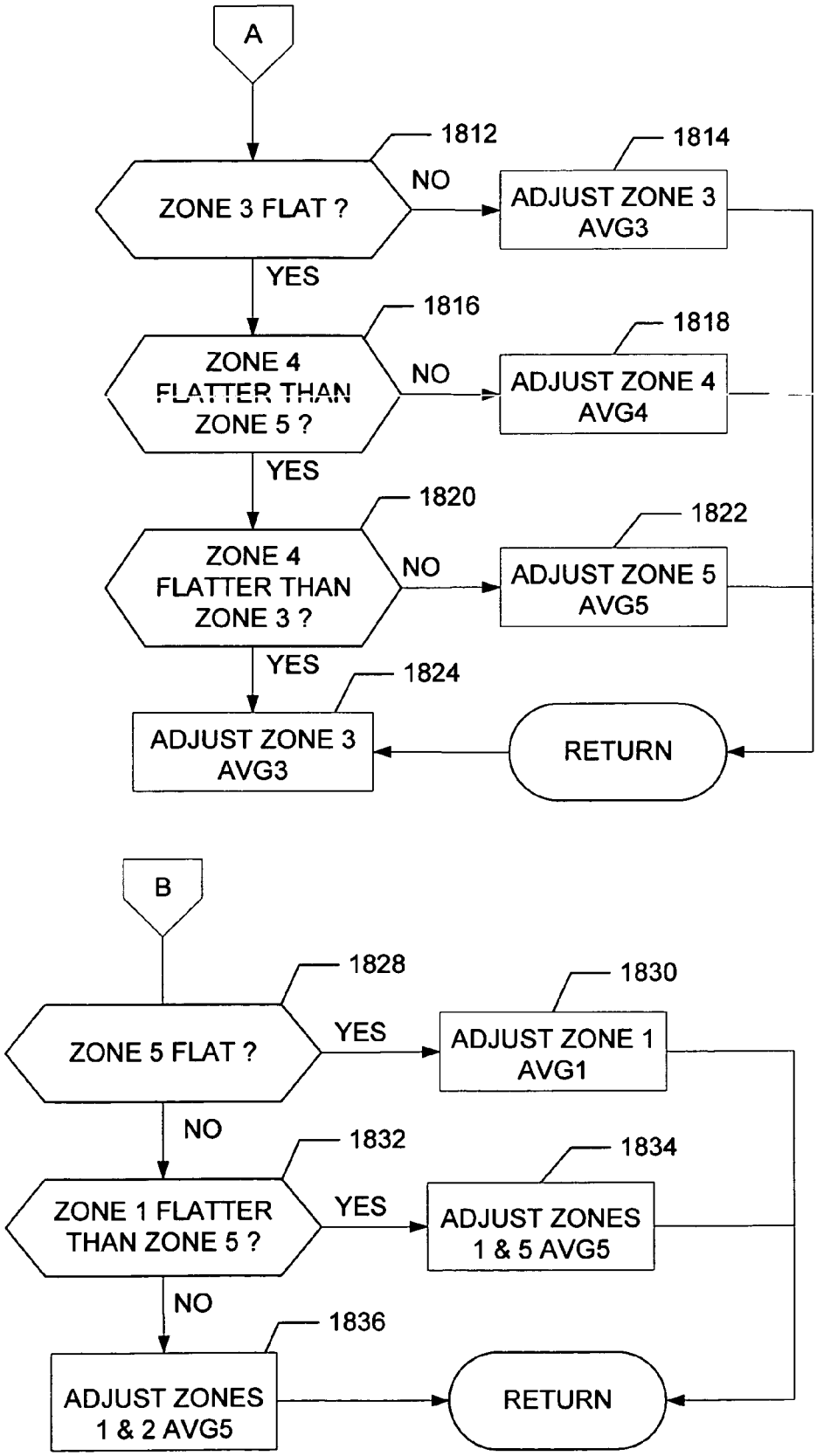

FIGS. 17 and 18 are a more detailed flow diagram depicting one manner in which the determine zone changes method (block 1406) of FIG. 14 may be implemented. In the example method of FIGS. 17 and 18, five sensing, material condition monitoring and/or adjustment zones are used. In particular, zone 1 corresponds to the distance sensor 1102 (FIG. 11) and a first outer edge of the strip material 100. In a similar manner, zones 2, 3, 4 and 5 correspond to the distance sensors 1104, 1106 and 1108, respectively, and to longitudinal regions of the strip material 100, including a first mid-edge, a center, a second mid-edge and a second outer edge, respectively. In addition, for purposes of clarity, the material conditioner 1002 (FIG. 10) is described as having five corresponding adjustment zones (i.e., adjustment zones 1 through 5 that correspond to the five longitudinal regions of the strip material 100 and the sensor zones 1 through 5. However, it should be recognized, as noted above, that there does not necessarily have to be a one-to-one correspondence between the number and/or location of adjustment zones (e.g., adjustable backup bearings) and the number and/or location of the sensor zones. For example, each sensor zone and/or material zone may be mapped to or may correspond to two or more adjustment zones of the material conditioner 1002 (FIG. 10).

Continuing with the example zone definitions as set forth above, the system 1000 initially determines if the all of the zones (i.e., zones 1 through 5) associated with the strip material 100 are substantially flat (block 1708). Such a flatness determination may be made by, for example, comparing the average deviation and/or the maximum I-units for each of the zones to a predetermined threshold value corresponding to a desired or substantially flat condition. If the system 1000 determines at block 1708 that all of the zones are substantially flat, then control is passed to block 1408 of FIG. 14.

On the other hand, if the system 1000 determines at block 1708 that all of the zones are not substantially flat (i.e., at least one of the zones is not substantially flat), then the system 1000 determines if zone 1 is substantially flat (block 1710). If zone 1 is substantially flat, then control is passed to block 1812 of FIG. 18. At block 1812, a determination is made whether zone 3 is substantially flat. If zone 3 is not substantially flat, then the system 1000 determines that zone 3 should be adjusted by an amount equal to the average deviation for zone 3 (block 1814) and control is returned to block 1408 (FIG. 14). On the other hand, if zone 3 is substantially flat (block 1812), then the system 1000 determines if zone 4 is flatter (e.g., has smaller I-units value and/or average deviation value) than zone 5 (block 1816). If zone 4 is not flatter than zone 5 (block 1816), then the system 1000 determines that zone 4 is to be adjusted by the average deviation of zone 4 (block 1818) and control is returned to block 1408 (FIG. 14). If zone 4 is flatter than zone 5 (block 1816), then the system 1000 determines whether zone 4 is flatter than zone 3 (block 1820). If zone 4 is not flatter than zone 3 (block 1820), then the system 1000 determines that zone 5 is to be adjusted by the average deviation of zone 5 (block 1822) and control returns to block 1408 (FIG. 14). On the other hand, if zone 4 is flatter than zone 3, then the system 1000 determines that zone 3 is to be adjusted by the average amount of deviation of zone 3 (block 1824) and control is returned to block 1408 (FIG. 14).

If it is determined at block 1710 (FIG. 17) that zone 1 is not substantially flat, then the system 1000 determines if zone 2 is substantially flat (block 1726). If zone 2 is substantially flat (block 1726), then control is passed to block 1828 of FIG. 18. At block 1828, the system 1000 determines if zone 5 is substantially flat. If zone 5 is substantially flat at block 1828, then the system 1000 determines that zone 1 is to be adjusted by an amount equal to the average deviation of zone 1 (block 1830) and control is returned to block 1408 (FIG. 14). On the other hand, if zone 5 is not substantially flat at block 1828, then the system 1000 determines if zone 1 is flatter than zone 5 (block 1832). If zone 1 is flatter than zone 5 (block 1432), then the system 1000 determines that zones 1 and 5 are to be adjusted by an amount equal to the average deviation for zone 5 (block 1834) and control is returned to block 1408 (FIG. 14). On the other hand, if the system 1000 determines at block 1432 that zone 1 is not flatter than zone 5 (block 1832), then the system 1000 determines that zones 1 and 2 are to be adjusted by an amount equal to the average deviation for zone 5 (block 1836) and control is returned to block 1408 (FIG. 14).

If the system 1000 determines at block 1726 that zone 2 is not substantially flat, then the system 1000 determines if zone 5 is substantially flat (block 1740). If zone 5 is substantially flat (block 1740), then the system 1000 determines if zone 1 is flatter than zone 2 (block 1742). If zone 1 is flatter than zone 2 at block 1742, then zones 1 and 2 are adjusted by an amount equal to the average deviation of zone 2 (block 1744). On the other hand, if zone 1 is not flatter than zone 2 at block 1742, then the system 1000 determines at block 1746 that zones 1 and 3 are to be adjusted by an amount equal to the average deviation of zone 1 (block 1746) and control is returned to block 1408 (FIG. 14). On the other hand, if the system 1000 determines at block 1740 that zone 5 is not substantially flat, then the system 1000 determines that zones 1 and 2 are to be adjusted by an amount equal to the average deviation of zone 1 (block 1748) and control is returned to block 1408 (FIG. 14).

FIGS. 19-25 are more detailed flow diagrams depicting an example manner in which the adjust conditioner method (block 1408) of FIG. 14 may be implemented. In general, the example methods depicted in FIGS. 19-25 receive the zone change information from block 1406 and generate appropriate adjustment commands, instructions and/or signals that cause the material conditioner 1002 (FIG. 10) to adjust its work rolls 1004 (FIG. 10) to achieve a desired material condition, which in this is example is a substantially flat condition. In particular, zone change information includes the zone (s) to be changed and the amount of change required (e.g., the average deviation of a particular zone). The particular manner in which the zone change information is processed by the system 1000 is based on which zone(s) are to be changed. Thus, adjustments to zones 3, 1 and 4 only are carried out using the methods of FIG. 19, 20 and 21, respectively. Simultaneous adjustments to zones 1 and 5 are carried out using the method depicted in FIG. 22. Simultaneous adjustments to zones 1 and 2 are carried out using the method depicted in FIG. 23. Simultaneous adjustments to zones 1 and 3 are carried out using the method depicted in FIG. 24, and adjustments to zone 5 are carried out using the method shown in FIG. 25.

Also, generally, the methods of FIGS. 19-25 determine the relative size of the adjustment to be made and select one of two adjustment step size sets based on the size of the adjustment to be made. The step size sets are amounts by which the adjustable backup bearings 1006 (FIG. 10) and, thus, the work rolls 1004 (FIG. 10) of the material conditioner 1002 (FIG. 10) are moved during an adjustment interval. The step size sets may be selected to optimize the ability of the system 1000 (FIG. 10) to quickly change the work roll profiles to achieve a desired material condition, without resulting in excessive overshoot, oscillation, etc. In general, larger step sizes enable a more rapid adjustment toward a desired material condition, while smaller step sizes enable more accurate control of the material condition. The methods of FIGS. 19-25 use two different sets of step sizes so that, initially, if the deviation from a desired material condition (e.g., substantial flatness) is relatively large (e.g., the average deviation value for a zone is relatively large), the set having larger step sizes is used.

If the average deviation for a zone to be adjusted is initially relatively small or is reduced via prior adjustments (e.g., using a large step size adjustment), the set having the smaller step sizes may be used. In this manner, the example methods of FIGS. 19-25 provide the benefit of fast adjustment when deviations from a desired material condition are large and the benefits of greater precision as the deviations are reduced.

Figure 19:
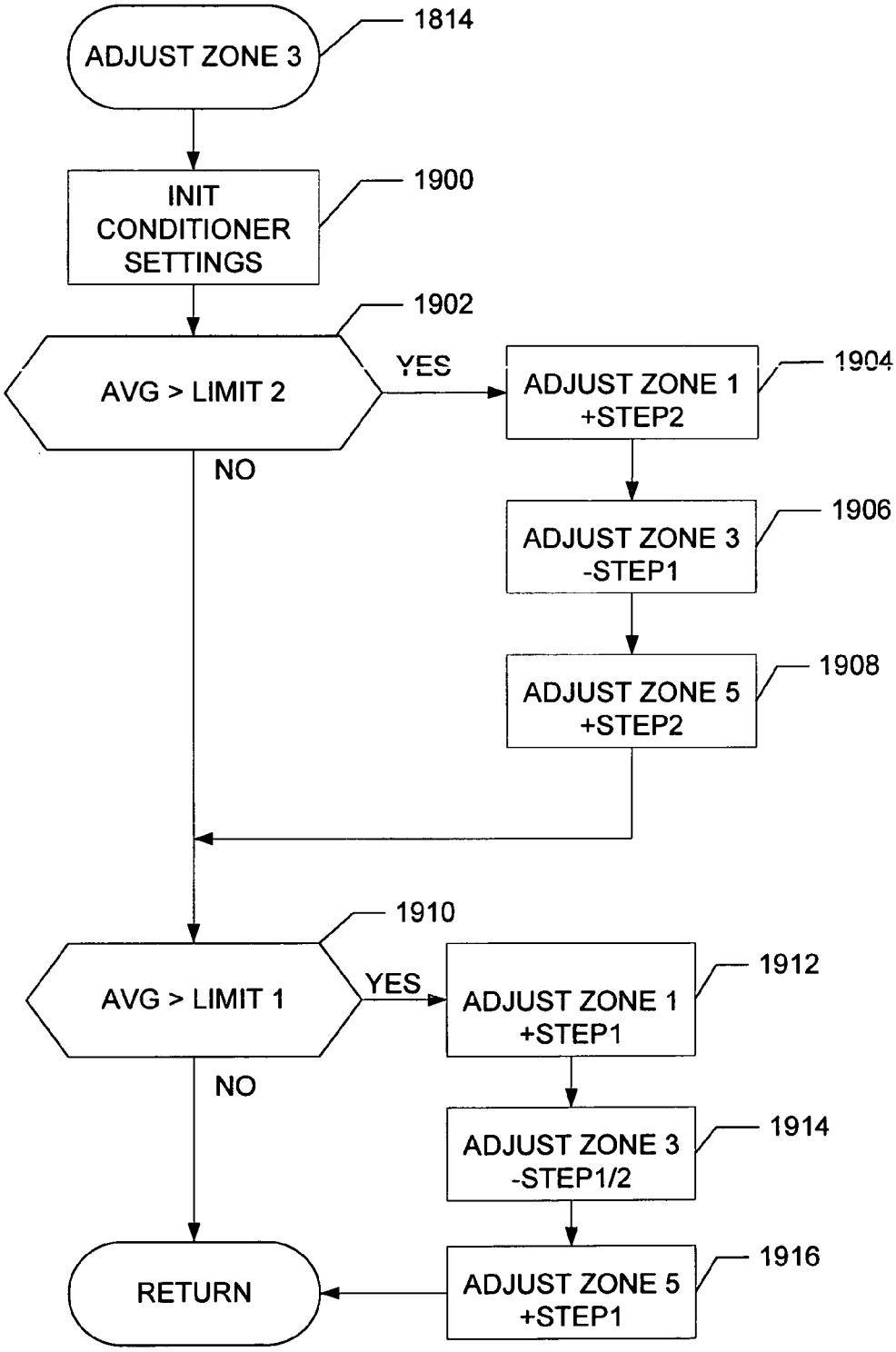
FIGS. 19-25 are more detailed flow diagrams depicting an example manner in which the adjust conditioner method of FIG. 14 may be implemented.
Figure 20:
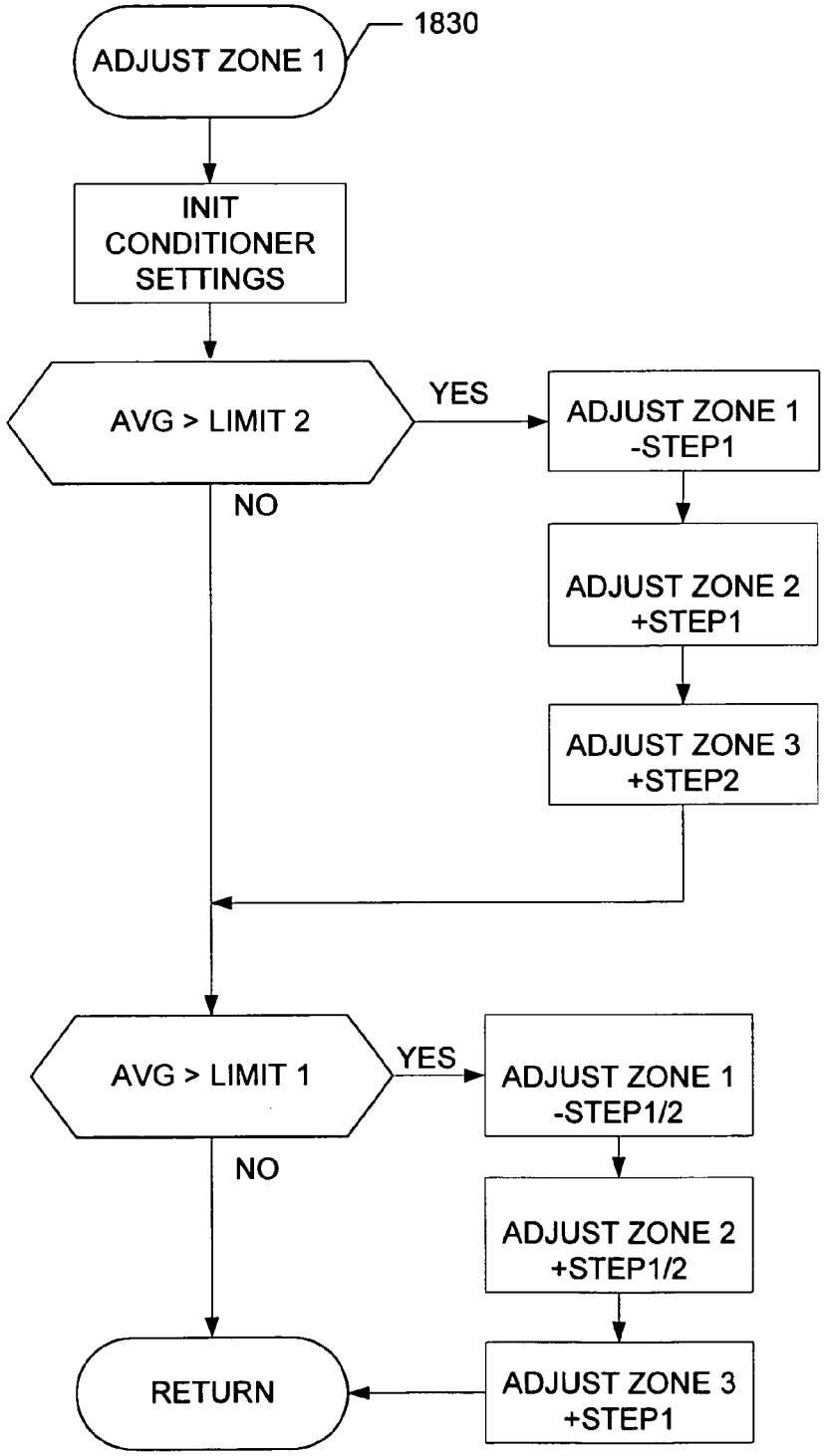
Figure 21:
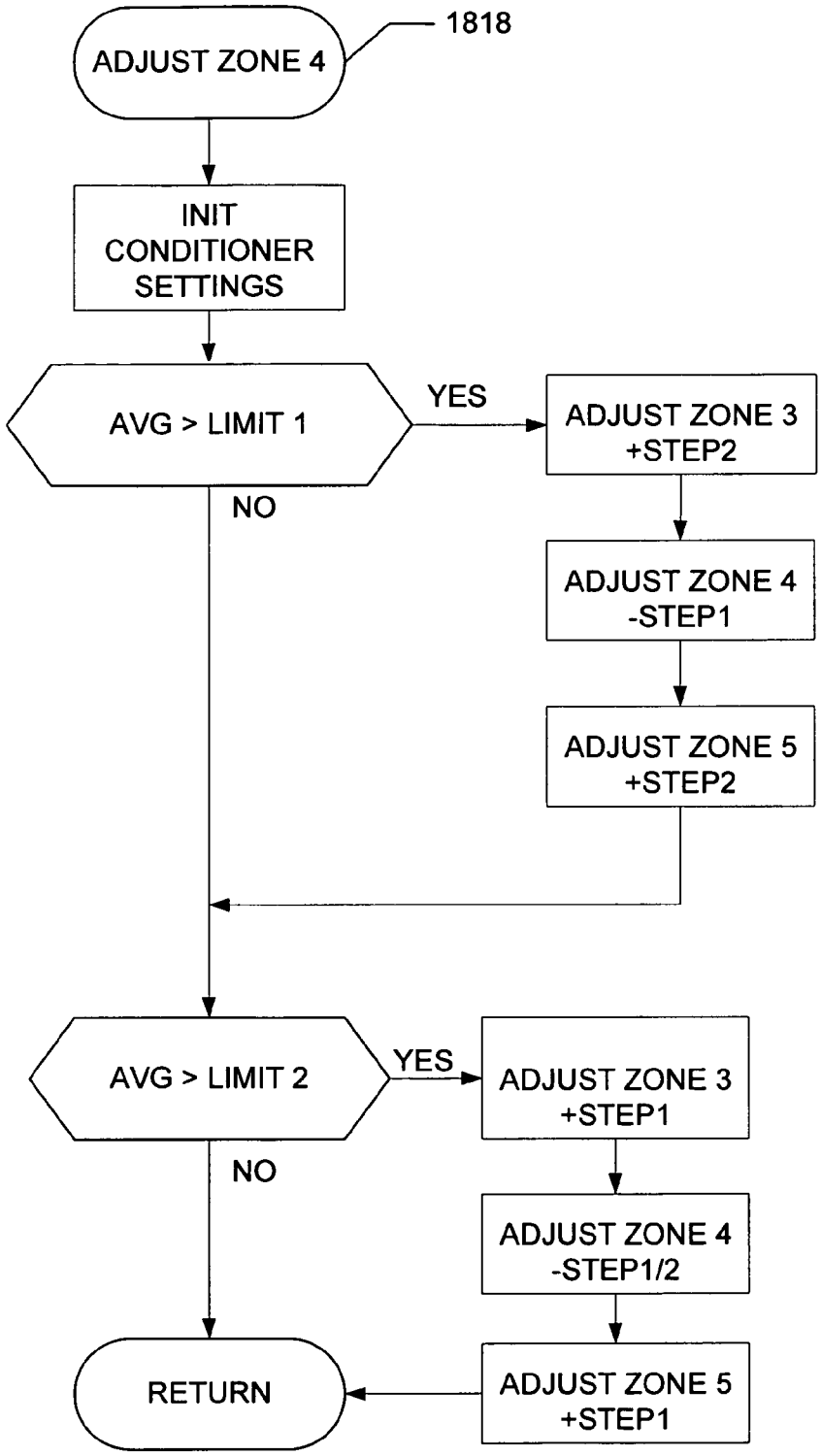
Figure 22:
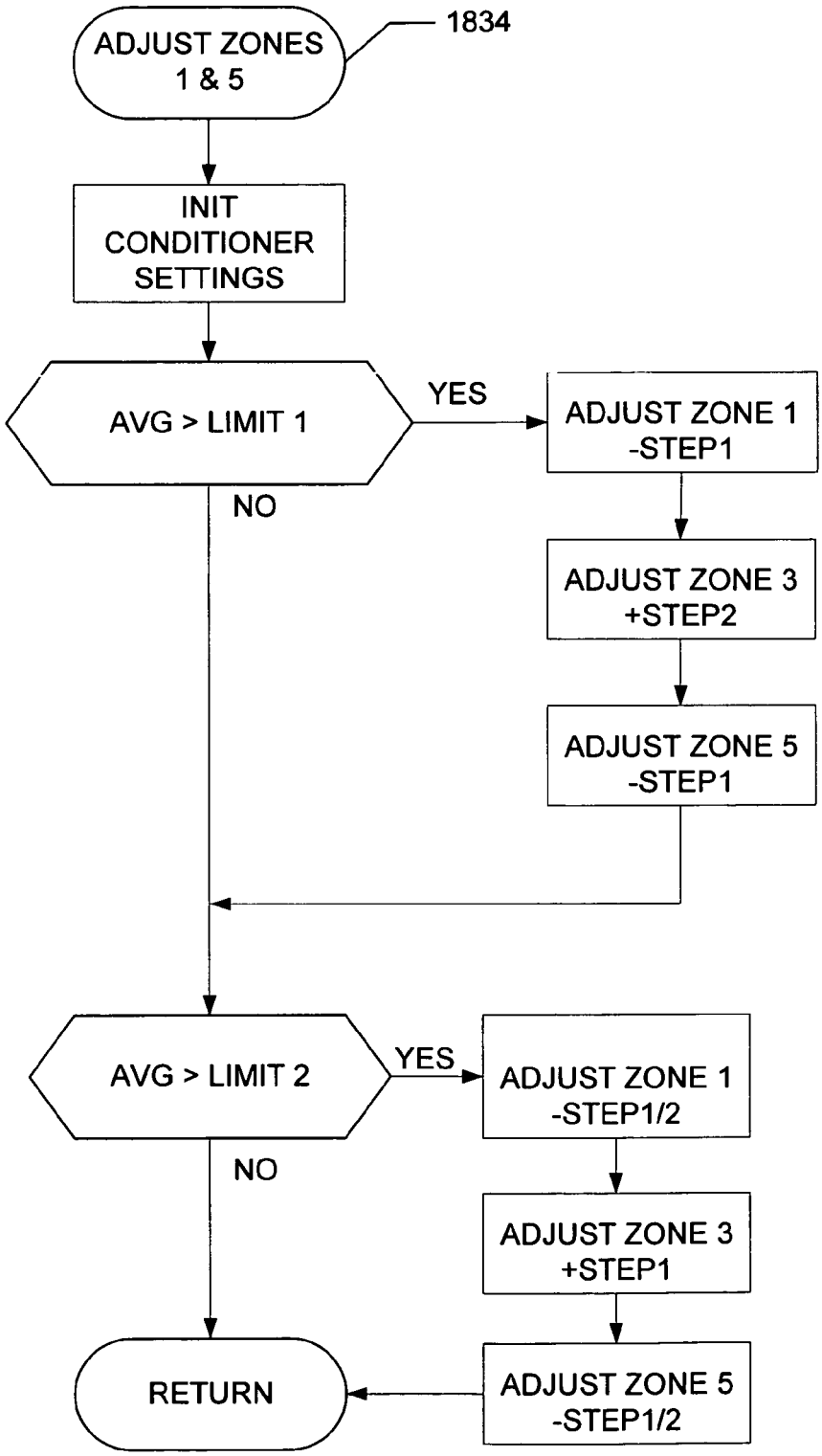
Figure 23:
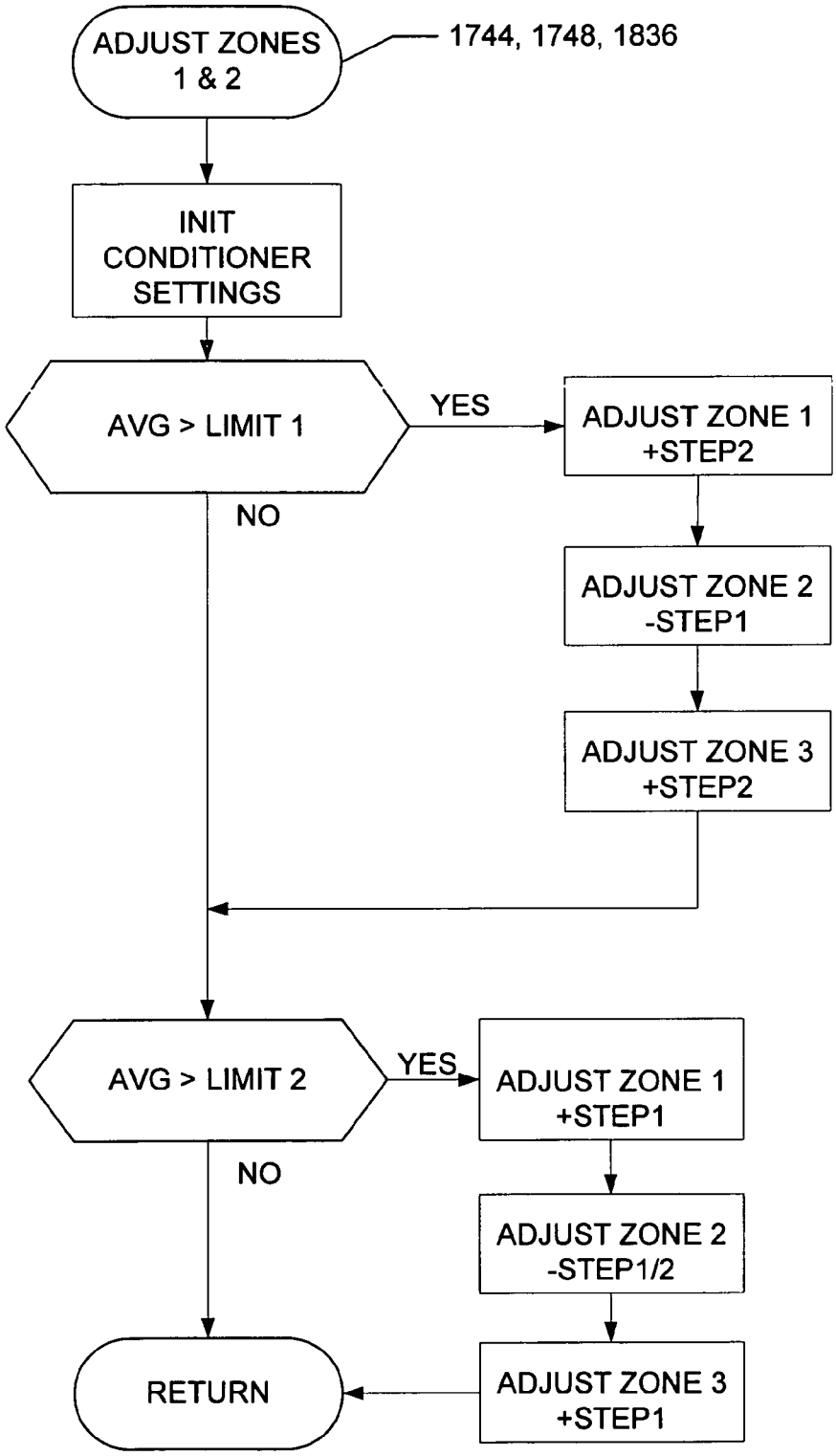
Figure 24:
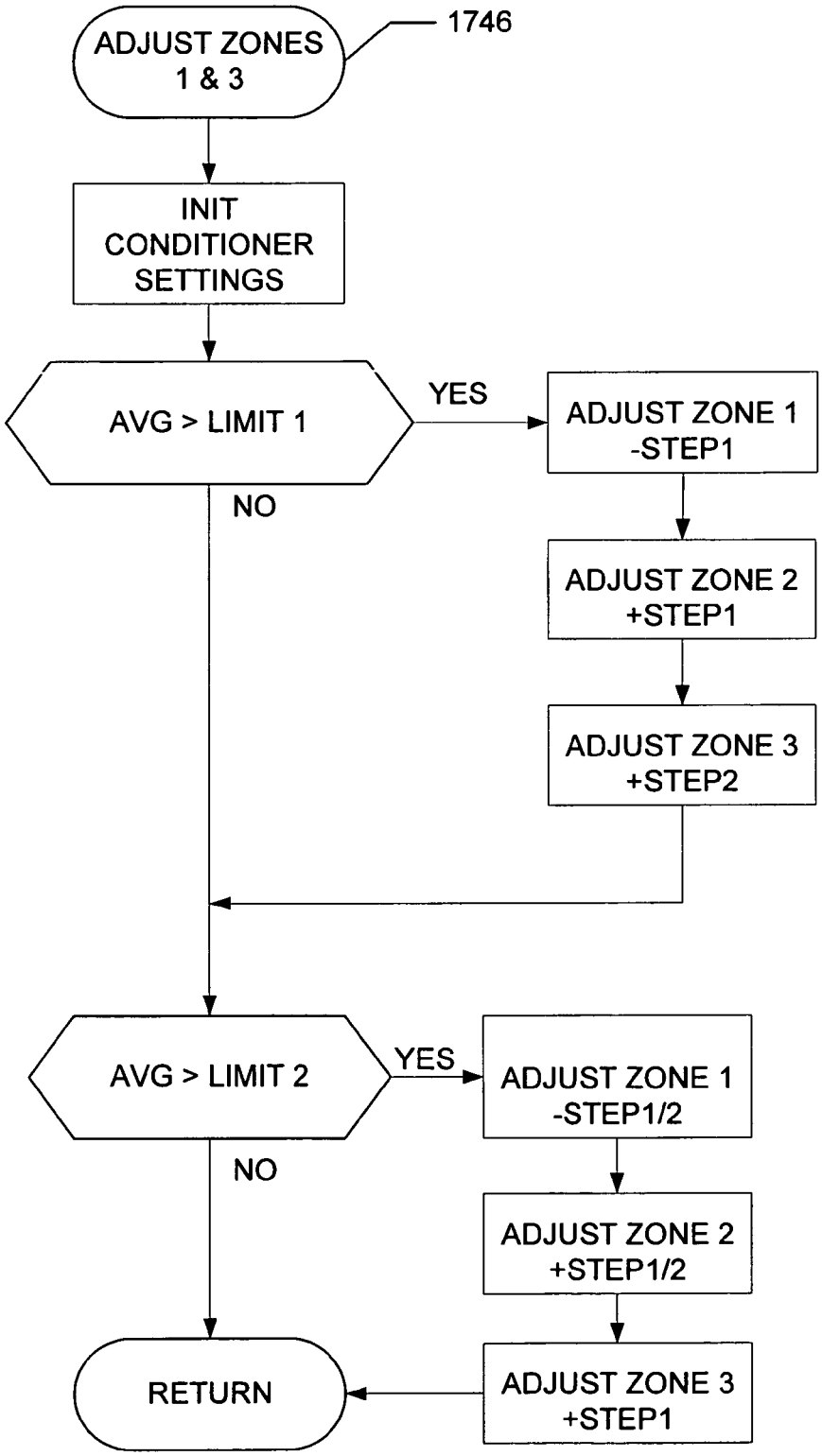
Figure 25:
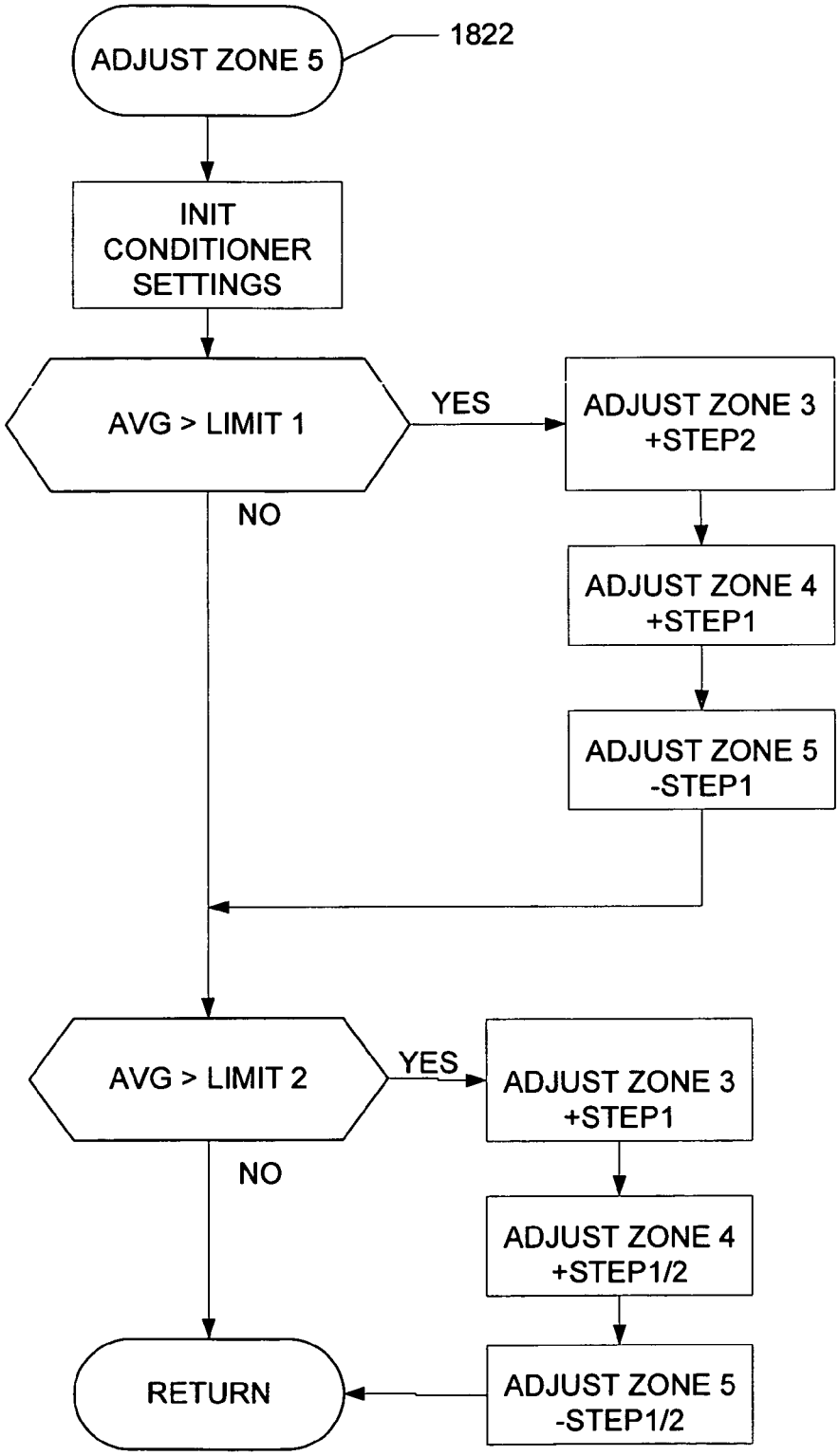

Now turning in detail to FIG. 19, an example manner by which a command or determination to adjust zone 3 by an amount "AVG" initializes the settings of the material conditioner 1002 (block 1900). At block 1902, the system 1000 determines if the amount zone 3 is to be adjusted (i.e., AVG) is greater than a threshold value (i.e., Limit 2) representative of a relatively large adjustment amount. If the value of AVG exceeds the threshold value (Limit 2), then zone 1 is adjusted up by a first step amount (STEP2) (block 1904), zone 2 is adjusted down by a second step (STEP1) (block 1906) and zone 5 is adjusted up by the first step (Step 2) amount (block 1908).

At block 1910, the system 1000 determines if the adjustment value AVG is greater than another limit or threshold (Limit 2) representative of a relatively smaller adjustment (i.e., in comparison to the threshold used in block 1902). If the adjustment value AVG is greater than the other threshold (Limit 1), then zone 1 is adjusted up by an amount equal to STEP 1, zone 3 is adjusted down by an amount equal to STEP 1/2, and zone 5 is adjusted up by an amount equal to STEP 1.

The methods of FIGS. 20-25 are similar to those shown in FIG. 19 and, thus, are not described in additional detail herein. Any desired step sizes may be used with the methods of FIGS. 19-25. However, in some examples, the value of STEP2 may be double the value of STEP 1, which is double the value of STEP 1/2. Of course, other relative step sizes or relationships and/or more than or fewer than three step sizes may be used if desired.

Figure 26:
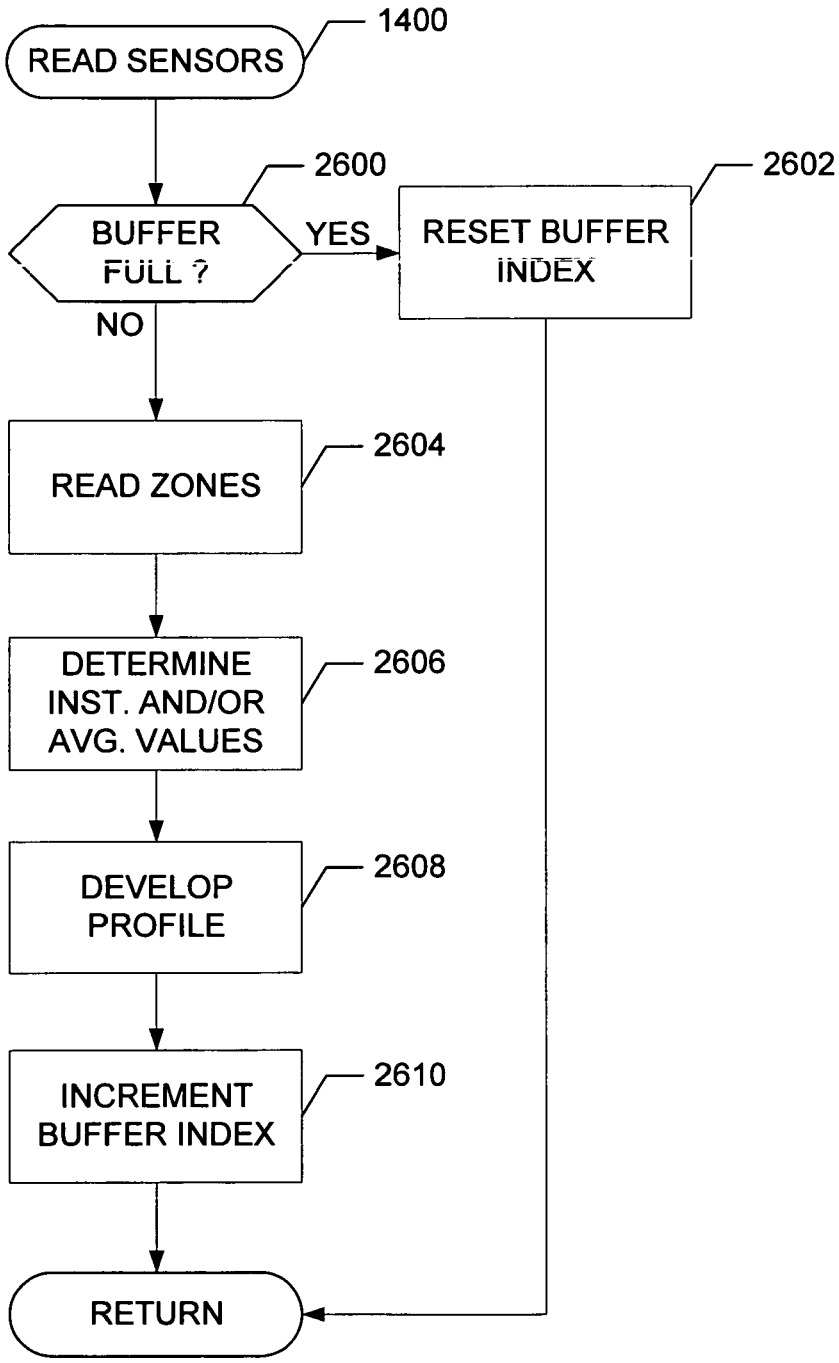
FIG. 26 is a more detailed flow diagram depicting another manner in which the read sensors method of FIG. 14 may be implemented.

FIG. 26 is another detailed flow diagram depicting an example manner in which the read sensors method (block 1400) of FIG. 14 may be implemented. Initially, the system 1000 determines if the data buffer is full (block 2600). If the data buffer is full, the buffer index is reset to a predetermined value (e.g., zero) (block 2602). On the other hand, if the data buffer is not full at block 2600, control is passed to block 2604.

At block 2604, the system 1000 (e.g., the MMCF 1016) reads the zones. In particular, the system 1000 may acquire distance or deviation information from each of the distance sensors 1102-1108 (FIG. 11) and the encoder 1110 (FIG. 11) over a predetermined number of sampling intervals. For example, each of the distance sensors 1102-1108 (FIG. 11) may be polled or read on a periodic basis (i.e., at fixed time intervals or some other predetermined times) by the MMCF unit 1016 (FIG. 11).

The information received by the MMCF unit 1016 may correspond to the individual distances between the sensors 1102-1108 and the upper surface of the strip material 100 underlying the sensors 1102-1108.

Preferably, but not necessarily, the sensors 1102-1108 are calibrated so that the surface of the material conditioner 1002 opposite the sensors 1102-1108 and across which the strip material 100 moves through the material conditioner 1002 (e.g., the tops of the work rolls 1004) is equal to a zero distance or other predetermined distance value. In this manner, any deviation of the material condition of the strip material 100 (e.g., waves, buckles, crossbow, etc.) may be detected as positive (i.e., greater than zero) distance variations across zones (e.g., crossbow) and/or distance variations along one or more of the longitudinal regions or zones of the strip material 100 (e.g., a wave along an edge).

The system 1000 may also include a warning device (not shown) capable of warning an operator of the determined deviation of the material condition of the strip material 100. For example, the warning device may warn the operator that the strip material 100 is approaching an "out of spec" tolerance and that the settings on the material conditioner 1002 may need to be corrected. The system 1000 may included at least one predefined set point, i.e., tolerance limit, established to trigger different levels of warning and/or alarm for the operator. The warning device may be, for instance, a light device, such as a stack of green, amber, and/or red lights, each of which could indicate a different level of warning and/or alarm, such as: (1) green, indicating that the material condition of the strip material 100 is within specification tolerance; (2) amber, indicating that the material condition of the strip material 100 is approaching the tolerance limit; and (3) red, indicating that the material condition of the strip material 100 is beyond the tolerance limit, and the production cycle has been, or should be halted. The warning device may additionally or alternatively include an audio emitter to output an audio signal representative of the material condition of the strip material 100.

In each instance that zone distance information is read from the sensors 1102-1108 (FIG. 11), length information is read from the encoder 1110 (FIG. 11) and is associated with the distance information. Thus, the zone information (e.g., distance information and length information) may be envisioned as a data table in which each column of the table uniquely corresponds to one of the sensors 1102-1108 and the encoder 1110, and each of the rows represents a sampling event or time. The number of sampling events or times (e.g., rows of data) may be selected to suit the particular needs of a given material monitoring and/or conditioning application. For example, in some applications more than a thousand sampling events may take place at block 2604. However, other applications may require more or fewer sampling events.

After the zone data has been read at block 2604, the system 1000 (e.g., the MMCF unit 1016) determines the instantaneous and/or the average deviation or distance readings within each zone, or across multiple zones (block 2606).

Additionally or alternatively, at block 2608 the system 1000 may develop a dimensional profile of the strip material 100 that has or is passing through the conditioner 1002. For example, the MMCF unit 1016 (FIG. 11) may utilize the instantaneous deviation or distance or the average deviation or distance (calculated at block 2604) to develop a dimensional profile. The dimensional profile may be a two dimensional (e.g., a cross section) or three dimensional (e.g., a topographical map) representation of the strip material at either an instantaneous moment (i.e., a snap-shot of the strip material), or over a predetermined length of time or distance (i.e., the average condition of the strip material).

Additionally, the dimensional profile may correspond to each sensor individually, or may group the readings of some of the sensors into a zone reading.

For instance, in one embodiment, the dimensional profile may be a plot of the each of the sensor readings stored in the data table, in which each column (i.e. plot point) of the table uniquely corresponds to one of the sensors 1102-1108 and the encoder 1110, and each of the rows represents a sampling event or time. Alternatively, the dimensional profile may be a plot of the grouping of individual sensor readings (e.g., zone readings) into one or more zones in which each plot point corresponds to an average of a group of sensors 1102-1108. After the dimensional profile has been determined at block 2608, the system 1000 increments the buffer index (block 2610).

Figure 27:
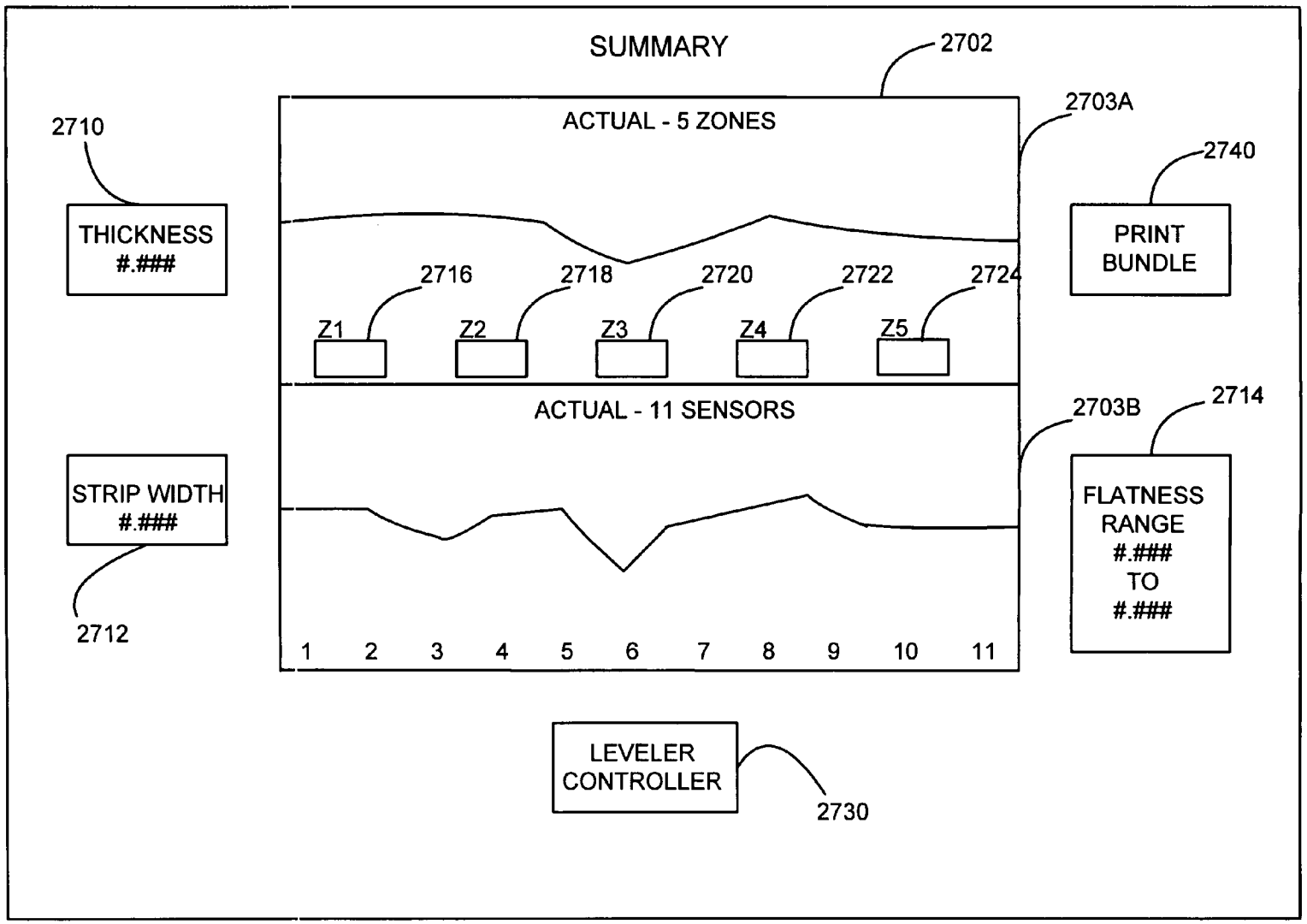
FIG. 27 is an illustration of an embodiment of a visual display that may be provided during operation of the material monitoring and conditioning feedback unit.

FIG. 27 is an illustration of an embodiment of a visual display 2700 that may be provided on the display 1218 during operation of the material monitoring and conditioning feedback unit shown schematically in FIG. 10. Referring to FIG. 27, the display 2700 may include a video image 2702 of at least one dimensional profile as determined at the block 2608 (FIG. 26). For instance, the video image 2702 may include a first cross section dimensional profile 2703A, corresponding to zone readings (e.g., 5 zones), and/or a second cross section dimensional profile 2703B, corresponding to individual sensor readings (e.g., 11 actual sensors). Each of the dimensional profiles 2703A and 2703B may visually indicate material condition information, such as the flatness of the strip material, to the operator. For example, the system 100 may compare the actual sensor reading to a predetermined tolerance limit, and display the results of the comparison as an indication of the condition of the strip material 100 as related to the tolerance limit. Additionally, each of the dimensional profiles 2703A and 2703B may include various overlays, such as defect highlights, stress profiles, quality ratings, or any other measurement. Still further, as described above, any of the dimensional profiles 2703A or 2703B may be a two dimensional, three dimensional, or other suitable dimensional profile.

The display 2700 may additionally and/or alternatively include other video images 2710, 2712, 2714, and 2716-2724 showing the instantaneous and/or average sensor readings determined at the block 2604. For example, the display 2710 may correspond to a numerical indication of the thickness of the strip material 100, the display 2712 may correspond to the width of the strip material 100, and display 2714 may correspond to the flatness range, e.g., maximum and minimum of the strip material 100. The graphical displays 2716-2724 may provide information regarding the material condition of each zone, or alternatively, may correspond to the actual sensors, such as sensors 1102-1108 as similarly described above. In this example, each of the graphical displays 2716-2724 correspond to particular zone of the strip material 100 as it travels under, in this instance, eleven actual sensors. Each of the graphical displays 2716-2724 may show the flatness reading for the associate zone or sensor. It will be appreciated that the manner in which the numbers are graphically displayed may be altered by one of ordinary skill in the art and may include, other visually representative views, such as, for instance, a graphical bar display, or other suitable display.

Figure 28:
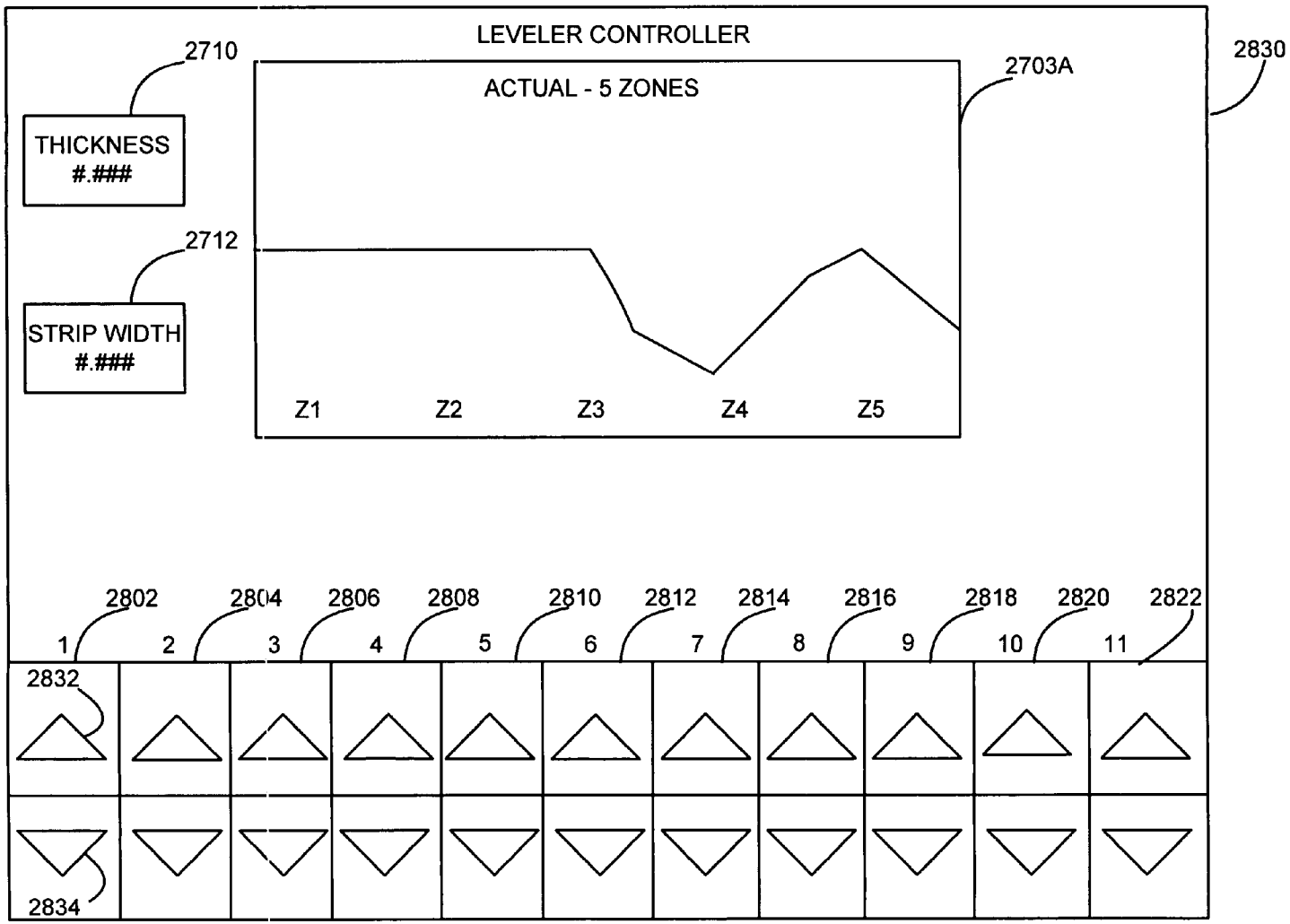
FIG. 28 is an illustration of an another embodiment of a visual display that may be provided during operation of the material monitoring and conditioning feedback unit.

In some embodiments, an operator may manually control the material condition of the strip material 100, by a selecting a leveler controller button 2730, which provides to the operator, the controller display of FIG. 28. For example, selecting the leveler controller button 2730 may cause a plurality of user-selectable buttons 2802-2822 to be provided on a display 2830. In this example, each of the user selectable button 2902-2822 correspond to one of a plurality of distance sensors, in this case 11 sensors, which detect the distance to a surface of the strip material 100.

For example, in this illustration, the buttons 2802 and 2804 may be associated with the first and second of a plurality of distance sensors located over the strip material, while the buttons 2820 and 2822 are second to last and last distance sensor, etc. In this example, each of the buttons 2802-2822 may include an "up arrow" symbol 2832 and/or a "down arrow" symbol 2834 for operating the material conditioner. It will be appreciated that the number of buttons, the association between the buttons and the sensors, symbols, or words located on the buttons may be any suitable design choice.

In operation, the user may "press" or select one or more of the buttons 2802-2822, and more particularly, one of the symbols 2832 or 2834 via direct "touch-screen" selection, computer mouse selection, or other suitable input device. By selecting one or more of the buttons 2802-2822, the user generates control information responsive to the displayed material condition information, to cause the system 100 to adjust a load applied to the strip material based on the control information to urge the condition of the strip material 100 toward a desired condition, as described above. For example, if the user notices that the portion of the dimensional profile in the display 2703A corresponding to the area of "zone 3" is not flat, the user may press either buttons 2810-2814, or any other desirable button, to manipulate the material conditioner to change the load on the strip material 100 and urge the strip material 100 to a flat condition. Similarly, the user may fine-tune the shape of the material by selecting multiple buttons as desired.

Figure 29:
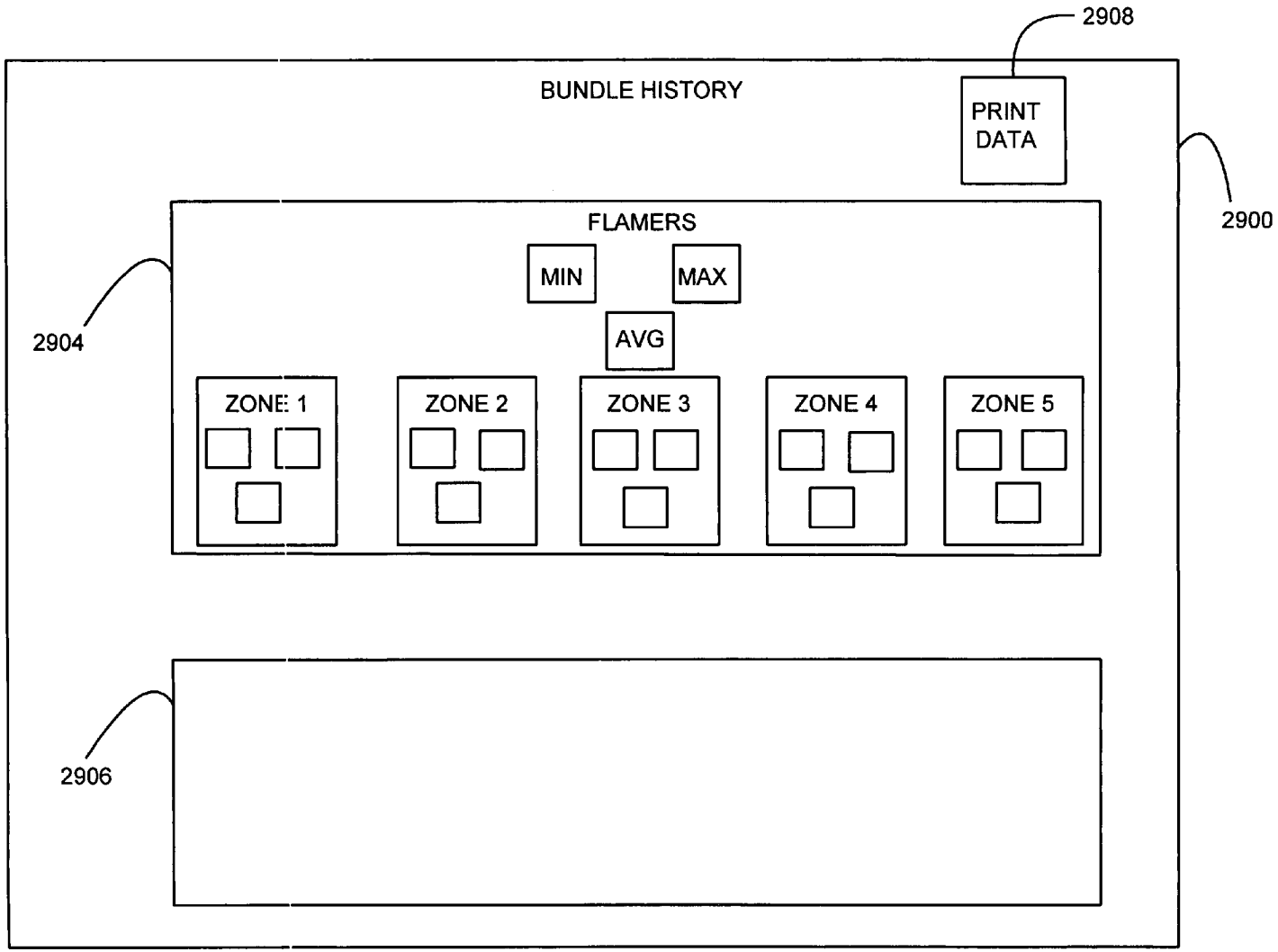
FIG. 29 is an illustration of an another embodiment of a visual display that may be provided during operation of the material monitoring and conditioning feedback unit.

The display 2700 similarly may additionally and/or alternatively include a print bundle button 2740, which provides to the operator, the bundle history display of FIG. 29. For example, selecting the print bundle button 2740 may cause a bundle summary 2904 to be provided on a display 2900. In this example, the bundle summary 2904 includes a minimum, maximum, and/or average "flatness" number for each of the zones, e.g., zones 1 to 5, associated with the strip material 100 and determined at the block 2604 (FIG. 26). Additionally, the display 2906 may include a display portion 2906, for displaying, entering, or recording notes associated with the bundle, such as, for instance, material conditioner setting, or the like. Still further, the display 2900 may include a print data button 2908, which prints a bundle label, for affixing or otherwise associating the data with the bundle, and containing certification information for that bundle, as described above.

Although the description herein discloses example systems including, among other components, software executed on hardware, it should be noted that such systems are merely illustrative and should not be considered as limiting. For example, it is contemplated that any or all of the disclosed hardware and software components could be embodied exclusively in dedicated hardware, exclusively in software, exclusively in firmware or in some combination of hardware, firmware and/or software.

Although certain methods, apparatus, and articles of manufacture have been described herein, the scope of coverage of this patent is not limited thereto. On the contrary, this patent covers all apparatus, methods, and articles of manufacture fairly falling within the scope of the appended claims either literally or under the doctrine of equivalents.

What is claimed is:

1. A system for monitoring a condition of a strip material comprising:

a processor;

a display operatively coupled to the processor; and a memory communicatively coupled to the processor, the memory comprising stored instructions that when executed cause the processor to:

obtain a plurality of sensor readings associated with a plurality of longitudinal zones along a length of the material as the material moves;

determine the condition of the strip material as the strip material moves past each of the plurality of sensors by determining a difference between a first wave height of the material in a first one of the longitudinal zones and a second wave height of the material in a second one of the longitudinal zones based on at least some of the plurality of sensor readings;

convert the determined condition of the material into a dimensional profile of the strip material; and output to the display, the dimensional profile of the strip material.

2. A system as defined in claim 1, wherein the memory further comprises stored instruction that when executed cause the processor system to:

obtain control information responsive to the condition of the strip material; and adjust a load applied to the strip material based on the control information as the strip material moves to urge the condition of the material toward a desired condition.

3. A system as defined in claim 1, wherein the plurality of sensor readings include an instantaneous deviation or distance of the strip material from a predetermined zero point.

4. A system as defined in claim 1, wherein the memory further comprises stored instructions that when executed cause the processor to acquire travel length information associated with the strip material as the strip material moves through the system.

5. A system as defined in claim 4, wherein the memory further comprises stored instructions that when executed cause the processor to generate a three dimensional profile associated with the strip material based on the travel length information and the plurality of sensor readings, and to output to the display the three dimensional profile.

6. A system as defined in claim 1, wherein the plurality of sensor readings are generated by at least one of a contact sensor or a non-contact sensor.

7. A system as defined in claim 1, further comprising stored instructions that when executed cause the processor to output via one of an audio emitter, or a light device, a signal representative of the condition of the strip material.

8. A system as defined in claim 1, further comprising stored instructions that when executed cause the processor to compare at least one of the plurality of sensor readings to an associated tolerance limit and output via the display, a visual display of the comparison between the at least one of the plurality of sensor reading to the associated tolerance limit.

9. A system as defined in claim 1, further comprising stored instructions that when executed cause the processor to convert the plurality of sensor readings to an average reading associated with the condition of the strip material along a length of the strip material as the strip material moves, and outputting via the display, a visual display of the average reading.

10. A system as defined in claim 2, wherein obtaining control information responsive to the condition of the strip material further comprises receiving transmitted control information from a remote location.

11. A system as defined in claim 1, further comprising stored instructions that when executed cause the processor to generate a certification label associated with the condition of the strip material.

12. A system as defined in claim 11, wherein the generated certification label comprises at least one of a weight of the strip material, a strip material specification, a barcode, or a flatness certificate.

13. A system as defined in claim 1, further comprising stored instructions that when executed cause the processor to output via the display, at least one of a graph, a chart, a table, or text.

14. A system as defined in claim 1, further comprising stored instructions that when executed cause the processor to output via the display, process information associated with the moving strip material.

15. A system as defined in claim 14, wherein the process information includes at least one of, a thickness of the strip material, a width of the strip material, a maximum flatness reading, or a minimum flatness reading.

* * * * *

UNITED STATES PATENT AND TRADEMARK OFFICE
Certificate

Patent No. 7,461,529 B2 Patented: December 29, 2008

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: John Dennis Clark, McPherson, KS (US); and Clarence B. Cox, III, McPherson, KS (US)

Signed and Sealed this Thirtieth Day of March 2010.

Dana Ross
*Supervisory Patent Examiner*
Art Unit 3725